US011703004B2

(12) United States Patent
Sukegawa et al.

(10) Patent No.: US 11,703,004 B2
(45) Date of Patent: Jul. 18, 2023

(54) INTERNAL COMBUSTION ENGINE CONTROL DEVICE AND INTERNAL COMBUSTION ENGINE CONTROL METHOD

(71) Applicant: HITACHI ASTEMO, LTD., Hitachinaka (JP)

(72) Inventors: Yoshihiro Sukegawa, Tokyo (JP); Masayuki Saruwatari, Hitachinaka (JP); Shinya Sato, Hitachinaka (JP)

(73) Assignee: HITACHI ASTEMO, LTD., Ibaraki (JP)

( * ) Notice: Subject to any disclaimer, the term of this patent is extended or adjusted under 35 U.S.C. 154(b) by 0 days.

(21) Appl. No.: 17/784,914

(22) PCT Filed: Dec. 15, 2020

(86) PCT No.: PCT/JP2020/046671
§ 371 (c)(1),
(2) Date: Jun. 13, 2022

(87) PCT Pub. No.: WO2021/153053
PCT Pub. Date: Aug. 5, 2021

(65) Prior Publication Data

US 2023/0016942 A1 Jan. 19, 2023

(30) Foreign Application Priority Data

Jan. 31, 2020 (JP) ..... 2020-014464

(51) Int. Cl.
*F02D 41/00* (2006.01)
*F02D 41/14* (2006.01)

(52) U.S. Cl.
CPC ..... *F02D 41/0097* (2013.01); *F02D 41/1498* (2013.01); *F02D 2041/1432* (2013.01)

(58) Field of Classification Search
CPC ..... F02D 41/0097; F02D 41/1498; F02D 2041/1432
See application file for complete search history.

(56) References Cited

U.S. PATENT DOCUMENTS 5,913,299 A 6/1999 Shimizu et al.
7,753,032 B2 * 7/2010 Iihoshi ..... F02M 59/102 123/457

(Continued)

FOREIGN PATENT DOCUMENTS

JP H10-047122 A 2/1998
JP 2011-241759 A 12/2011

(Continued)

*Primary Examiner* — Sizo B Vilakazi
(74) *Attorney, Agent, or Firm* — Volpe Koenig

(57) ABSTRACT

Provided is an internal combustion engine control device that is capable of accurately estimating a stable combustion state at low cost. An internal combustion engine control device according to one aspect of the present invention includes: a rotational speed calculation unit 122*a* that calculates a time-series value of a crank rotational speed of an internal combustion engine; a rotational, speed phase calculation unit 122*b* that calculates a phase of the crank rotational speed from the time-series value of the crank rotational speed calculated by the rotational speed calculation unit; and a cycle variation calculation unit 122*c* that calculates the magnitude of variation between cycles of the phase of the crank rotational speed calculated by the rotational speed phase calculation unit.

14 Claims, 14 Drawing Sheets

(56) References Cited

U.S. PATENT DOCUMENTS

| | | | | |
|---|---|---|---|---|
| 2012/0291722 | A1* | 11/2012 | Kanda | F01L 1/352<br>123/41.02 |
| 2014/0196677 | A1* | 7/2014 | Kameda | F01L 1/352<br>123/90.17 |

FOREIGN PATENT DOCUMENTS

| | | | |
|---|---|---|---|
| JP | 2017-115592 | A | 6/2017 |
| JP | 2018-173064 | A | 11/2018 |

* cited by examiner

| | ESTIMATION OF TORQUE VARIATION RATE BASED ON $\sigma_\omega$ | ESTIMATION OF TORQUE VARIATION RATE BASED ON $\sigma_\theta$ |
|---|---|---|
| EGR RATE | SMALL | LARGE |
| AIR-FUEL RATIO | SMALL | LARGE |
| ENGINE LOAD | HIGH | LOW |
| COOLING WATER TEMPERATURE | HIGH | LOW |
| TRANSIENT/STEADY | STEADY | TRANSIENT |
| ROTATIONAL SPEED | HIGH | LOW |
| ECU LOAD | HIGH | LOW |

INTERNAL COMBUSTION ENGINE CONTROL DEVICE AND INTERNAL COMBUSTION ENGINE CONTROL METHOD

TECHNICAL FIELD

The present invention relates to an internal combustion engine control device and an internal combustion engine control method, and particularly relates to a technique for estimating a stable combustion state.

BACKGROUND ART

Recently, in vehicles such as automobiles, regulations on fuel consumption (fuel efficiency) and exhaust gas harmful components have been strengthened, and such regulations tend to be further strengthened in the future. Under such circumstances, there is known a technique of estimating a state inside a combustion chamber of an engine and controlling the engine based on an estimation result. Since an air-fuel ratio, an ignition timing, or the like is appropriately controlled according to a current combustion state, it is possible to enhance thermal efficiency of the engine and reduce the emission of harmful gases.

In particular, in lean burn and exhaust gas recirculation (EGR), fuel consumption performance and exhaust performance are improved generally by increasing an air-fuel ratio or increasing an EGR rate. On the other hand, if the air-fuel ratio is excessively increased or the EGR rate is excessively increased, the combustion becomes unstable and a variation of a torque per cycle increases. Therefore, for example, PTL 1 discloses a technique of detecting a stable combustion state and controlling an internal combustion engine so as to achieve appropriate air-fuel ratio and EGR rate.

PTL 1 describes that the air-fuel ratio is controlled such that a combustion stability of the internal combustion engine becomes a predetermined stable state depending on an output from a combustion stability-detecting mean. Furthermore, PTL 1 describes that a variation amount of a crank rotational speed obtained by a crank angle sensor is used as a parameter indicating the combustion stability of the internal combustion engine.

Further, PTL 2 describes that a pressure sensor that measures a pressure in a combustion chamber is provided, and a combustion variation state as an unstable combustion state is detected based on a measurement result of the pressure sensor.

CITATION LIST

Patent Literature

PTL 1: JP H10-47122 A
PTL 2: JP 2018-173064 A

SUMMARY OF INVENTION

Technical Problem

A torque for rotating a crankshaft of the engine is generated by combustion in a cylinder of the internal combustion engine. Thus, when the combustion becomes unstable and the generated torque fluctuates every cycle, the crank rotational speed also changes every cycle. Therefore, the stable combustion state can be estimated by detecting the variation amount of the crank rotational speed as described in PTL 1.

However, inertia weights of a transmission, an axle, and the like are added in addition to an inertia weight of the crankshaft itself, and thus, a large moment of inertia acts around the crankshaft. This moment of inertia acts in a direction of suppressing the variation of the crank rotational speed. Thus, the variation of the crank rotational speed becomes smaller than the torque variation caused by the combustion, and there is a possibility that it is difficult to accurately estimate the stable combustion state due to deterioration of a signal-to-noise ratio (S/N).

Further, a method of detecting the combustion variation state based on the measurement result of the pressure sensor described in PTL 2 is not affected by the moment of inertia around the crankshaft, and the accuracy of detection of the stable combustion state is not affected by the inertia. However, there are problems such as an increase in cost due to installation of the pressure sensor, and degradation of the pressure sensor due to incomplete combustion products (deposits) or a high-temperature environment.

The present invention has been made in view of the above circumstances, and an object thereof is to provide an internal combustion engine control device and an internal combustion engine control method capable accurately estimating a stable combustion state at low cost.

Solution to Problem

In order to solve the above problem, an internal combustion engine control device according to one aspect of the present invention includes: a rotational speed calculation unit that calculates a time-series value of a crank rotational speed of an internal combustion engine; a rotational speed phase calculation unit that calculates a phase of the crank rotational speed from the time-series value of the crank rotational speed calculated by the rotational speed calculation unit; and a first cycle variation calculation unit that calculates the magnitude of a cycle-to-cycle variation of the phase of the crank rotational speed calculated by the rotational speed phase calculation unit.

Advantageous Effects of Invention

According to at least one aspect of the present invention, it is possible to provide the internal combustion engine control device capable of accurately estimating the stable combustion state at low cost.

Other objects, configurations, and effects which have not been described above become apparent from embodiments to be described hereinafter.

DESCRIPTION OF EMBODIMENTS

Hereinafter, examples of modes for carrying out the present invention will be described with reference to the accompanying drawings. In the present specification and attached drawings, constituent elements having substantially the same function or configuration will be denoted by the same reference sign, and the redundant description thereof will be omitted.

<First Embodiment> [Engine] First, an example of an engine to which the present invention is applied will be described with reference to FIG. 1.

Figure 1:
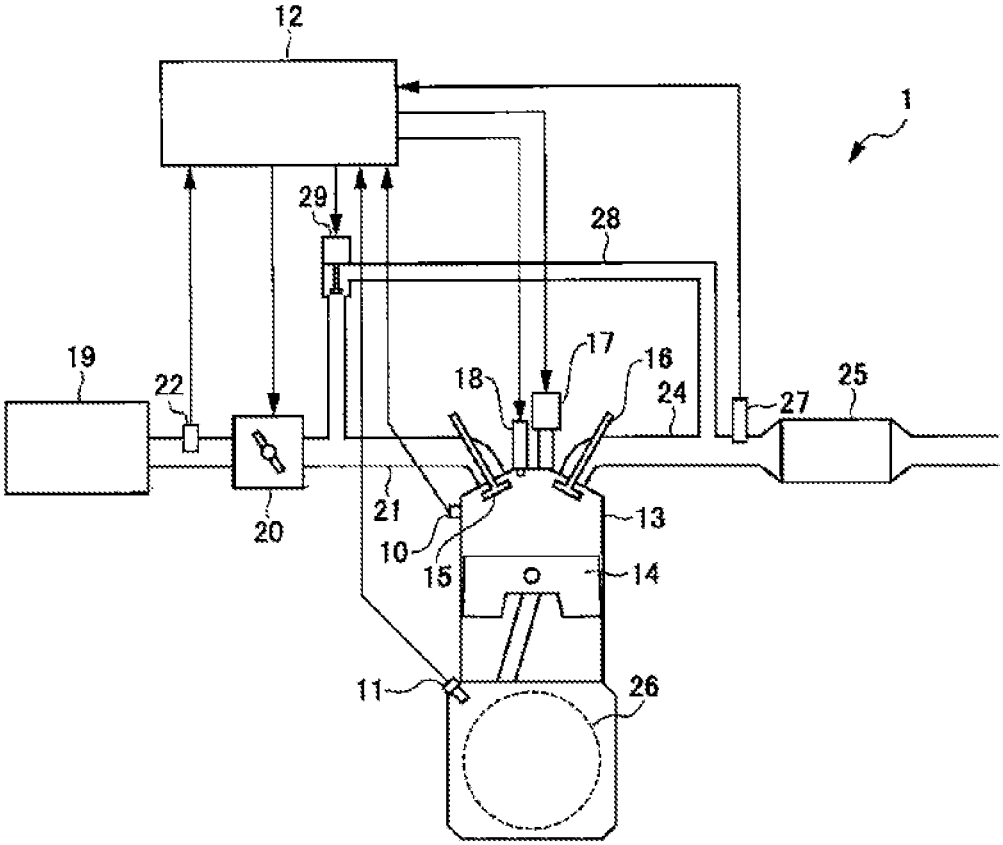
FIG. 1 is an explanatory diagram illustrating an example of a cross section of an engine according to a first embodiment of the present invention.

FIG. 1 illustrates an example of a cross section of an engine according to a first embodiment of the present invention.

An engine 1 is a spark ignition type four-cycle gasoline engine, and a combustion chamber is formed of an engine head, a cylinder 13, a piston 14, an intake valve 15, and an exhaust valve 16. In the engine 1, a fuel injection valve 18 is provided in the engine head, and an injection nozzle of the fuel injection valve 18 penetrates into the combustion chamber, thereby forming a so-called in-cylinder direct injection type internal combustion engine. Further, the engine head is also provided with an ignition plug 17. Air for combustion is taken into the combustion chamber through an air cleaner 19, a throttle valve 20, and an intake port 21. Then, a combusted gas (exhaust gas) discharged from the combustion chamber is discharged to the atmosphere through an exhaust port 24 and a catalytic converter 25.

The amount of air taken into the combustion chamber is measured by an air flow sensor 22 provided on the upstream side of the throttle valve 20. Further, an air-fuel ratio of the gas (exhaust gas) discharged from the combustion chamber is detected by an air-fuel ratio sensor 27 provided on the upstream side of the catalytic converter 25. Further, a knock sensor 10 is provided in a cylinder block (not illustrated) having a structure in which the cylinder 13 and a crankcase are integrated. The knock sensor 10 outputs a detection signal corresponding to a knock state quantity in the combustion chamber.

The exhaust port 24 and the intake port 21 communicate with each other by an EGR pipe 28, thereby forming a so-called exhaust gas recirculation system (EGR system) in which a part of the exhaust gas flowing through the exhaust port 24 is returned to the inside of the intake port 21. The amount of the exhaust gas flowing through the EGR pipe 28 is adjusted by an EGR valve 29.

Furthermore, a timing rotor 26 (signal rotor) is provided in a shaft portion of a crankshaft. The crank angle sensor 11 (detecting part) arranged to face the vicinity of the timing rotor 26 (part to be detected) detects the rotation of the timing rotor 26 to detect the rotation and a phase of the crankshaft, that is, a crank rotational speed (engine rotational speed). Detection signals of the knock sensor 10 and the crank angle sensor 11 are taken into a controller 12 and used for state detection and operating control of the engine 1 in the controller 12. In the present specification, the crank rotational speed is sometimes simply referred to as a "rotational speed".

The controller 12 outputs instructions such as an opening degree of the throttle valve 20, an opening degree of the EGR valve 29, a fuel injection timing and a fuel injection amount by the fuel injection valve 18, and an ignition timing by the ignition plug 17, and controls the engine 1 to a predetermined operation state. As the controller 12, for example, an engine control unit (ECU) can be used.

Note that only the single cylinder is illustrated in FIG. 1 to illustrate the configuration of the combustion chamber of the engine 1, the engine according to the embodiment of the present invention may be a multi-cylinder engine including a plurality of cylinders.

Figure 2:
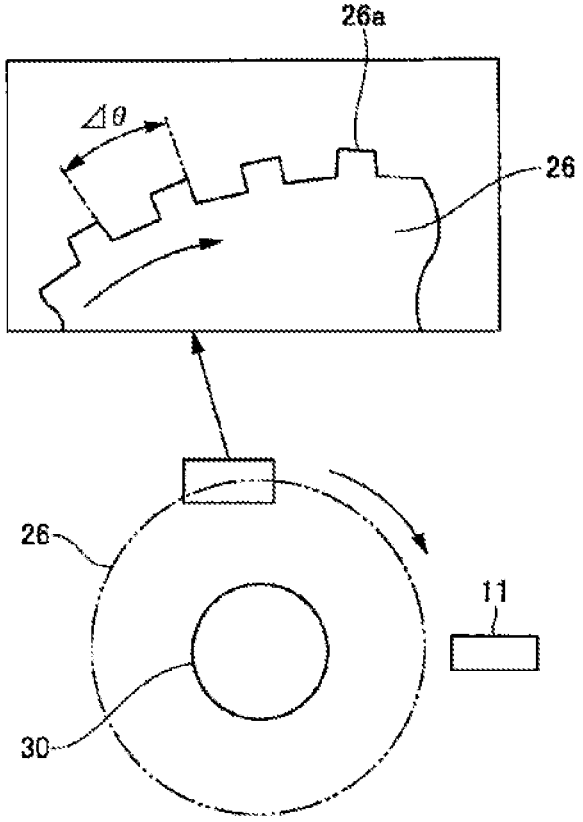
FIG. 2 is an explanatory view illustrating a principle of rotational speed detection by a crank angle sensor according to the first embodiment of the present invention.

[Detection Device for Crank Rotational speed] FIG. 2 illustrates a principle of detecting a crank rotational speed using the crank angle sensor 11 and the timing rotor 26.

On the outer periphery of the timing rotor 26 attached to a crankshaft 30 of the engine 1, signal teeth 26*a* are provided at constant angular intervals Δθ. The crank angle sensor 11 detects a time difference Δt between adjacent signal teeth 26*a* passing through the detecting part of the crank angle sensor 11, and obtains a crank rotational speed ω=Δθ/Δt [rad/s]. Since principle is used in the present embodiment, a crank rotational speed is detected for each rotation angle Δθ, and the crank rotational speed a an average rotational speed between the rotation angles Δθ.

Figure 3:
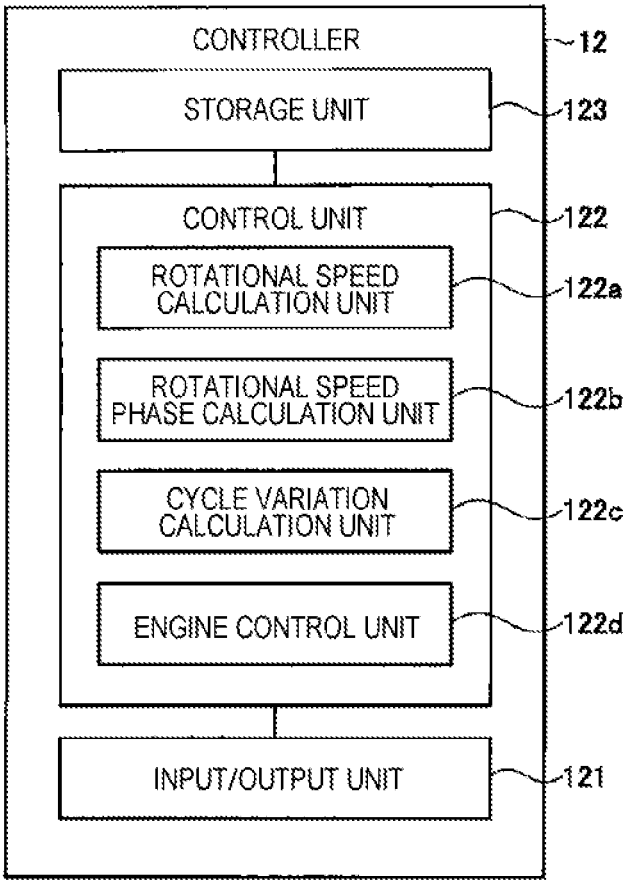
FIG. 3 is a block diagram illustrating a configuration example of a controller according to the first embodiment of the present invention.

[Controller] FIG. 3 is a block diagram illustrating a configuration example of the controller 12.

The controller 12 includes an input/output unit 121, a control unit 122, and a storage unit 123 that are electrically connected to each other via a system bus (not illustrated).

The input/output unit 121 includes an input port and an output port (not illustrated), and performs input and output processing on each device and each sensor in a vehicle on which the engine 1 is mounted. For example, the input/output unit 121 reads a signal of the crank angle sensor and transmits the signal to the control unit 122. Further, the input/output unit 121 outputs a control signal to each device according to a command of the control unit 122.

The control unit 122 controls the engine 1. For example, the control unit 122 controls the ignition timing, the throttle opening degree, and the EGR opening degree according to a stable combustion state of the engine 1. The control unit 122 includes a rotational speed calculation unit 122*a*, a rotational speed phase calculation unit 122*b*, a cycle variation calculation unit 122*c*, and an engine control unit 122*d*.

The rotational speed calculation unit 122*a* obtains a rotational speed of the timing rotor 26 per angular interval Δθ between the signal teeth 26*a* of the timing rotor 26, and generates time-series data corresponding to one cycle (crank angle 0° to 720°) of the engine 1 from the rotational speed per Δθ. Then, the rotational speed calculation unit 122*a* removes a noise component from the time-series data, and then, outputs the time-series data to the rotational speed phase calculation unit 122*b*.

The rotational speed phase calculation unit 122*b* obtains a phase value of the time-series data of the crank rotational speed from the time-series data of the crank rotational speed input from the rotational speed calculation unit 122*a*, and outputs the result thereof to the cycle variation calculation unit 122*c*.

The cycle variation calculation unit 122*c* calculates the magnitude (degree) of a cycle-to-cycle variation for the phase value of the time-series data of the crank rotational speed obtained by the rotational speed phase calculation unit 122*b*. Further, the cycle variation calculation unit 122*c* calculates the magnitude (degree) of a variation of an engine torque per cycle (hereinafter, described a "cycle variation") based on the magnitude (degree) of a cycle-to-cycle variation of the phase value of the time-series data of the crank rotational speed, and outputs the result thereof to the engine control unit 122*d*. Note that the variation of the engine torque per cycle is sometimes expressed as the "torque variation per cycle" in the present specification.

The engine control unit 122*d* controls the engine 1 based on the magnitude of the cycle variation of the engine torque obtained by the cycle variation calculation unit 122*c*.

The storage unit 123 is a volatile memory such as a random access memory (RAM) or a non-volatile memory such as a read only memory (ROM). In the storage unit 123, a control program to be executed by an arithmetic processing device (not illustrated) included in the controller 12 is recorded. The arithmetic processing device reads the control program from the storage unit 123 and executes the control program, whereby a function of each block of the control unit 122 is implemented. For example, a central processing unit (CPU) or a micro processing unit (MPU) can be used as the arithmetic processing device. Note that the controller 12 may include a non-volatile auxiliary storage device configured using a semiconductor memory or the like, and the control program may be stored in the auxiliary storage device.

[Engine Control] Next, engine control based on the cycle variation of the engine torque performed by the controller 12 will be described with reference to FIG. 4.

Figure 4:
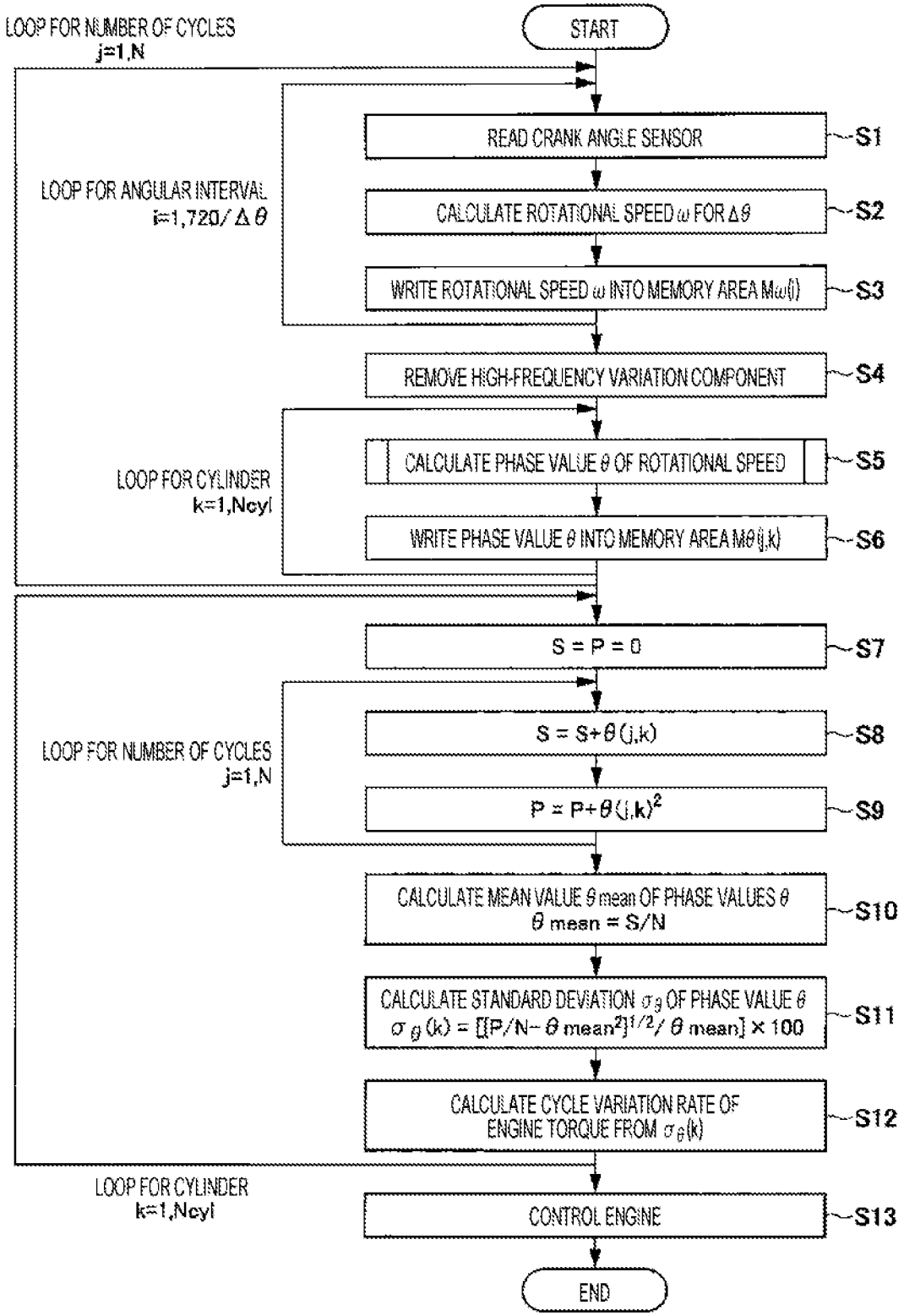
FIG. 4 is a flowchart illustrating a procedure example of engine control by the controller according to the first embodiment of the present invention.

FIG. 4 is a flowchart illustrating a procedure example of the engine control performed by the controller 12 based on the cycle variation of the engine torque.

In step S1, the rotational speed calculation unit 122*a* first reads an output value of the crank angle sensor 11 at a predetermined sampling cycle (S1). Then, the rotational speed calculation unit 122*a* calculates the rotational speed ω for Δθ from the output value of the crank angle sensor 11 per constant angular interval Δθ (S2), and writes the rotational speed ω into a memory area Mω(i) on the RAM (S3).

As the above processing from steps S1 to S3 is repeated for one cycle (between crank angles 0° and 720°), rotational speed time-series data ω(i) is obtained. Here, a possible range of i is represented by 1 to 720/Δθ. For example, in the case of Δθ=10°, the rotational speed time-series data ω(i) including a total of 72 points (i=1 to 72) between the crank angles 10° and 720° obtained in the memory area Mω(i).

The rotational speed time-series data ω(i) calculated in this manner contains a high-frequency variation component due to various factors (for example, mechanical rattling, electrical noise, and the like). This high-frequency variation component is generated independently of a combustion phenomenon, and thus, is likely to cause an error in the case of estimating the torque variation associated with the combustion variation. Therefore, it is necessary to remove the high-frequency variation component from the rotational speed time-series data ω(i). Therefore, the rotational speed calculation unit 122*a* removes the high-frequency variation component by reconstructing the rotational speed time-series data ω(i) using Fourier series expansion expressed by Formula (1) (S4).

[Formula 1]

$$\omega(\theta)' = \omega_0 + \sum_{k=1}^{n}\left\{c_k\cos\frac{k\cdot 2\pi(\theta-\theta_0)}{\Theta} + s_k\sin\frac{k\cdot 2\pi(\theta-\theta_0)}{\Theta}\right\} \quad (1)$$

$$c_k = \frac{2}{\Theta}\int_{\theta_0}^{\theta_0+8}\omega(\theta)\cos\frac{k\cdot 2\pi(\theta-\theta_0)}{\Theta}d\theta$$

-continued $$s_k = \frac{2}{\Theta}\int_{\theta_0}^{\theta_0+8} \omega(\theta)\sin\frac{k\cdot 2\pi(\theta-\theta_0)}{\Theta}d\theta$$

ω(θ): Original rotational speed ω(θ)': Reconstructed rotational speed k: Degree of trigonometric function θ: Crank angle Θ: Cycle period In the Fourier series expansion, original time-series data is reconstructed adding trigonometric functions having different frequencies. In Formula (1), k is the order of a trigonometric function, and the trigonometric function has a higher frequency as a value of k is larger. Therefore, when the rotational speed time-series data is reconstructed using the Fourier series expansion, if the addition of the trigonometric functions is truncated with appropriate order n, a variation component of a higher frequency than the order can be removed from the original rotational speed time-series data.

In a general three-cylinder four-cycle engine or four cylinders, it is desirable that truncation order n of the trigonometric function for removing a high-frequency component as noise from the rotational speed time-series data is about 3 to 5. However, it is considered that the appropriate truncation order n changes depending on a configuration and an operating condition of an engine.

For example, when the number of cylinders increases, a frequency of a rotational speed variation accompanying a variation of a torque (hereinafter, referred to as "combustion torque") generated by combustion increases. Therefore, it is desirable to increase the truncation order n to increase the frequency to be removed in order to appropriately reproduce the rotational speed variation component. Further, even when an engine operating speed increases, the frequency of the rotational speed variation accompanying the variation of the combustion torque increases, and thus, it is desirable to further increase the truncation order n. When the truncation order n of the trigonometric function in the Fourier series expansion is changed based on the number of cylinders and the engine operating speed in this manner, estimation accuracy is improved over a wide operating range in the estimation of the torque variation based on rotational speed information.

As described above, an internal combustion engine control device (the controller 12) according to the present embodiment includes a rotational speed calculation unit (the rotational speed calculation unit 122*a*) that performs finite-order Fourier series expansion (Formula (1)) on a time-series value (time-series data) of the crank rotational speed obtained from a detection result of a rotation angle sensor (the crank angle sensor 11) that detects a rotation angle of a crank to reconstruct the time-series value of the crank rotational speed.

Figure 5:
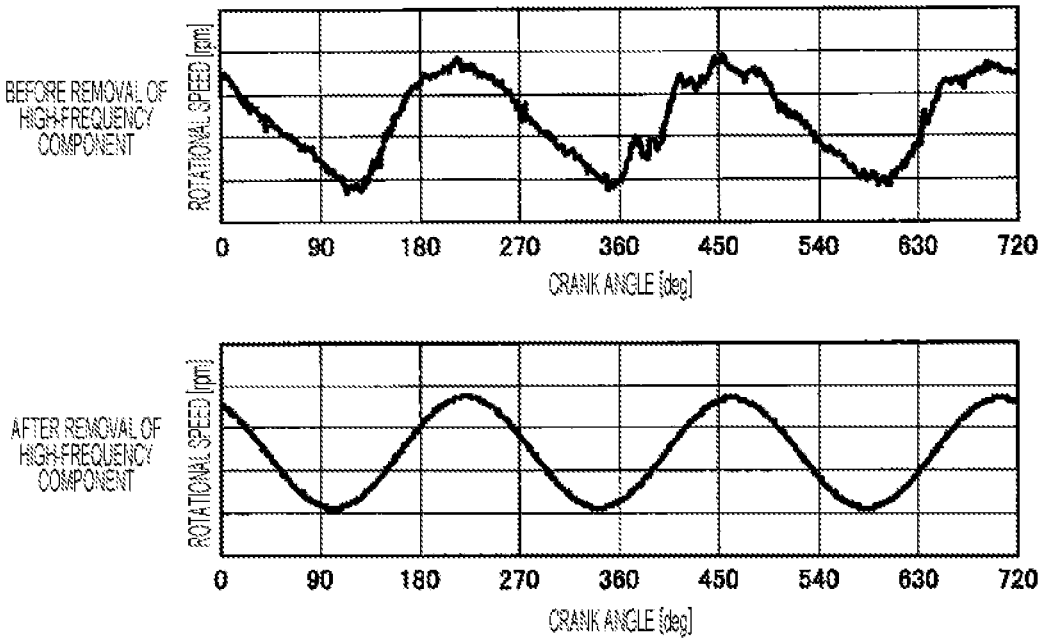
FIG. 5 is an explanatory view illustrating an example of rotational speed time-series data before and after removal of high-frequency components according to the first embodiment of the present invention.

[Rotational Speed Time-Series Data] FIG. 5 illustrates an example of rotational speed time-series data for one cycle (between crank angles 0° and 720°) of the engine 1. FIG. 5 is an example of a three-cylinder four-cycle engine. The upper side of FIG. 5 is an example of rotational speed time-series data (before removal of high-frequency components) in a case where the rotational speed obtained from the crank angle sensor 11 contains high-frequency variation components. Further, the lower side of FIG. 5 is an example of the rotational speed time-series data (after the removal of high-frequency components) in a case where the rotational speed time-series data on the upper side of FIG. 5 is subjected to Fourier series expansion using Formula (1) and addition to trigonometric functions is truncated at the fourth order. In the upper side of FIG. 5 and the lower side of FIG. 5, the horizontal axis represents the crank angle [deg], and the vertical axis represents the rotational speed [rpm].

In this example, the high-frequency variation components are removed by reconstructing the rotational speed time-series data using the Fourier series expansion, and only a low-frequency variation component haying a cycle of 240° is extracted. Such a low-frequency rotational speed variation is generated because the combustion torque acting on the crankshaft varies with intermittent combustion for each cylinder. Therefore, a cycle of the variation is the same as an explosion cycle of the engine. For example, in the three-cylinder four-cycle engine, the variation cycle is 240° (720°/3). Further, in a four-cylinder four-cycle engine, the variation cycle is 180° (720°/4).

The description returns to the flowchart of FIG. 4. After step S4, the rotational speed phase calculation unit 122*b* obtains a phase value θ of the rotational speed from the rotational speed time-series data from which the high-frequency variation component has been removed (S5). Here, the phase value θ is a phase value (crank angle) at a certain timing (sampling data) of a rotational speed waveform based on the rotational speed time-series data, and is used to obtain phase variation to be described later. The phase value θ of the rotational speed will be described with reference to FIG. 6.

Figure 6:
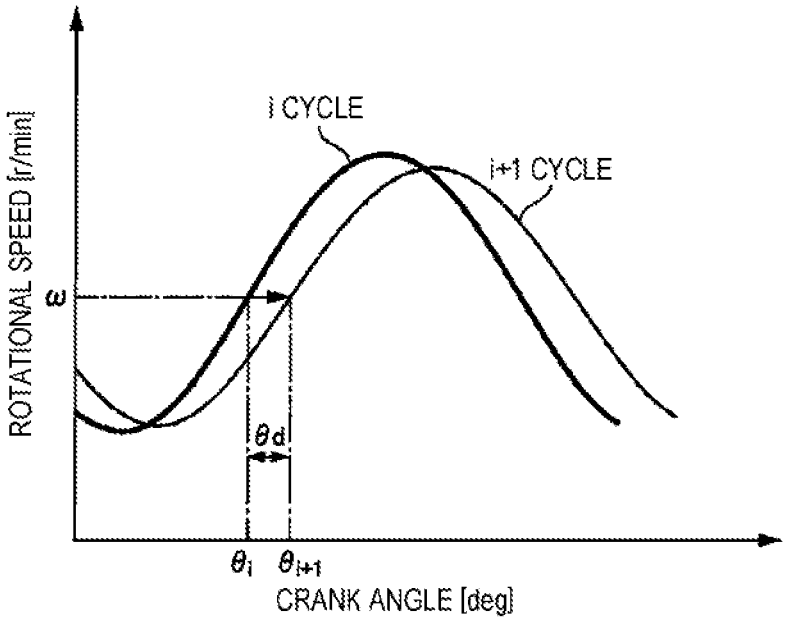
FIG. 6 is an explanatory view illustrating a phase value θ of a rotational speed according to the first embodiment of the present invention.

FIG. 6 is an example illustrating a part of each of rotational speed waveforms of different cycles. The horizontal axis represents the crank angle [deg], and the vertical axis represents the rotational speed [rpm].

In the engine 1, it is known that a time (ignition delay time) from discharge of an ignition plug to generation of an initial flame kernel, a flame propagation speed after ignition, and the like vary every cycle. Due to the variation thereof or the like, the generation timing of the combustion torque changes per cycle. Since the crank rotates by the combustion torque, the rotational speed waveform is advanced when the generation timing of the combustion torque is advanced, and the rotational speed waveform is retarded when the generation timing of the combustion torque is delayed. The phase value θ is used to represent an advance amount and a retard amount of the rotational speed waveform. That is, the generation timing of the combustion torque is reflected in the phase value θ.

FIG. 6 illustrates the rotational speed waveform (thick line) of the i-th cycle and the rotational speed waveform (thin line) of the (i+1)th cycle. The crank angle for a certain rotational speed ω in the i-th cycle is $\theta_i$ and the crank anode for the same rotational speed ω in the (i+1)th cycle is $\theta_{i+1}$ Therefore, a phase delay (retard) occurs between the i-th cycle and the (i+1)th cycle, and such a phase difference θd is obtained by $\theta_{i+1}-\theta_i$.

The phase value θ of the rotational speed can be obtained by various methods. For example, a crank angle at which a rotational speed becomes a maximum value is obtained as the phase value θ. Further, for example, a crank angle at which the rotational speed becomes a minimum value is obtained as the phase value θ. Further, for example, a crank angle when the rotational speed changes across a predetermined rotational speed (for example, the rotational speed ω in FIG. 6) may be obtained as the phase value θ.

[Method of Calculating Phase Value of Rotational Speed] In the present embodiment, as an example, a method of obtaining the crank angle (hereinafter, described as "maximum timing") at which the rotational speed becomes the maximum value as the phase value θ will be described with reference to FIG. 7.

Figure 7:
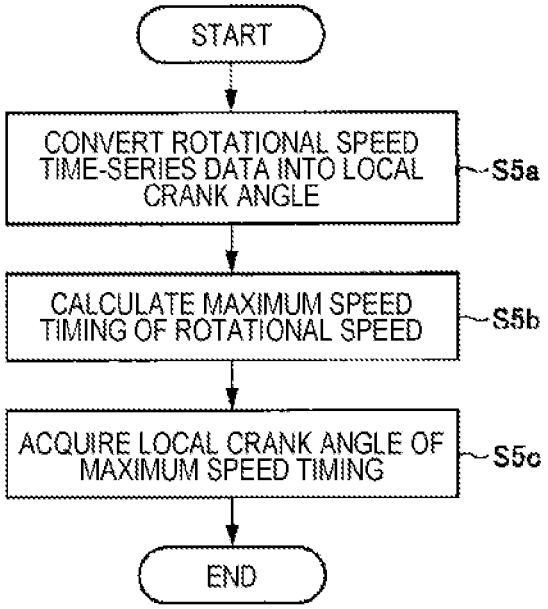
FIG. 7 is a flowchart illustrating a procedure example of a process of calculating the phase value θ of the rotational speed in step S5 of FIG. 4.

FIG. 7 is a flowchart illustrating a procedure for obtaining the phase value θ using the maximum timing in step S5.

In order to obtain the maximum timing, the rotational speed phase calculation unit 122*b* first converts the rotational speed time-series data of one cycle (between crank angles 0° and 720°) of the engine 1 into a local crank angle synchronized with a cycle of each cylinder (S5*a*). Next, a maximum speed timing at which the rotational speed becomes the maximum is calculated from the rotational speed time-series data converted into the local crank angle (S5*b*). Then, a local crank angle corresponding to the maximum speed timing is calculated (S5*c*). This is the maximum timing to be obtained.

Here, the conversion processing into the local crank angle in step S5*a* will be described with reference to FIGS. 8 to 10.

Figure 8:
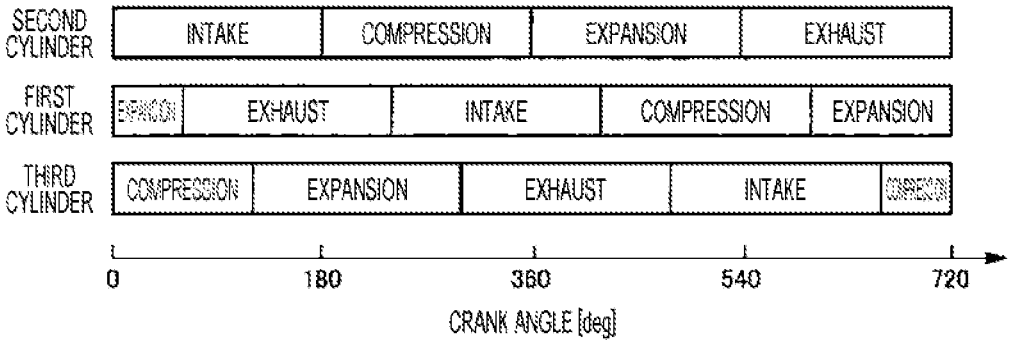
FIG. 8 is an explanatory view illustrating an example of a stroke sequence of three-cylinder four-cycle engine.

FIG. 8 illustrates an example of a stroke sequence of the three-cylinder four-cycle engine.

In a four-cycle engine, four strokes of intake, compression, expansion, and exhaust are per in order. Further, in a three-cylinder engine, strokes among cylinders are shifted each by a crank angle of 240°. When ignition is performed in the order of a second cylinder, a first cylinder, and a third cylinder, the stroke of the first cylinder is delayed by 240° with respect to the second cylinder. Further, the stroke of the third cylinder is delayed by 480° with respect to the second cylinder.

The combustion torque accompanying the explosion of each cylinder acts as an effective torque in a positive rotation direction of the crankshaft generally in a range from a compression top dead center (TDC 0°) to 90° after the compression top dead center (ATDC 90°). Therefore, in step S5*a* in FIG. 7, the rotational speed time-series data of one cycle (between crank angles 0° and 720°) is divided into sections (hereinafter referred to as "windows") each having the crank angle of 240° centered on 90° after the compression top dead center of each cylinder. Then, a crank angle of each window is replaced with a local crank angle using 90° after the compression top dead center of each cylinder as a reference (0°).

Figure 9:
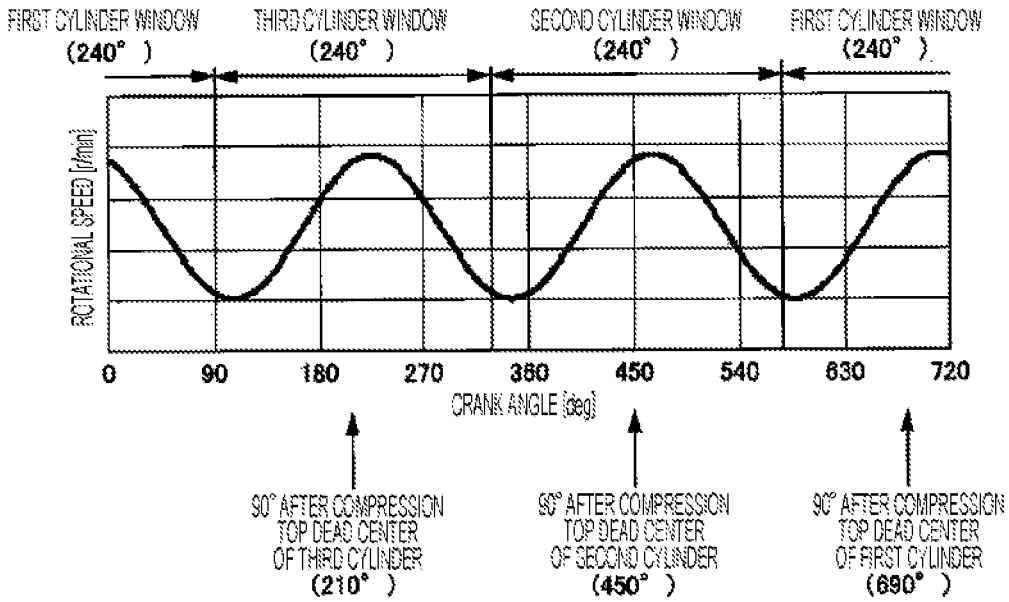
FIG. 9 is an explanatory view illustrating a method of setting a window for each cylinder with respect to rotational speed time-series data corresponding to one cycle according to the first embodiment of the present invention.

[Window Setting for Rotational Speed Time-Series Data] FIG. 9 illustrates an example in which rotational speed time-series data corresponding to one cycle is divided into windows each of which is centered on 90° after the compression top dead center of each cylinder. The horizontal axis represents the crank angle [deg], and the vertical axis represents the rotational speed [rpm].

A section between crank angles 90° and 330° incudes 90° after the compression top dead center of the third cylinder (a crank angle 210°), and thus, is defined as a third cylinder window. Similarly, a section between crank angles 330° and 570° including 90° after the compression top dead center of the second cylinder (a crank angle 450°) is defined as a second cylinder window. Furthermore, sections between crank angles 570° and 720° and between 0° and 90° including 90° after the compression top dead center of the first cylinder (a crank angle 690°) are defined as a first cylinder window.

When the respective windows are assigned to the rotational speed time-series data in this manner, rotational speed data of the third cylinder window strongly reflects a combustion state of the third cylinder as compared with pieces of rotational speed data of the other cylinder windows. Similarly, the rotational speed data of the second cylinder window strongly reflects a combustion state of the second cylinder as compared with pieces of the rotational speed data of the other cylinder windows. Furthermore, the rotational speed data of the first cylinder window strongly reflects a combustion state of the first cylinder as compared with pieces of the rotational speed data of the other cylinder windows. Therefore, it is possible to estimate the combustion state per cylinder by using the rotational speed data of each window.

Figure 10:
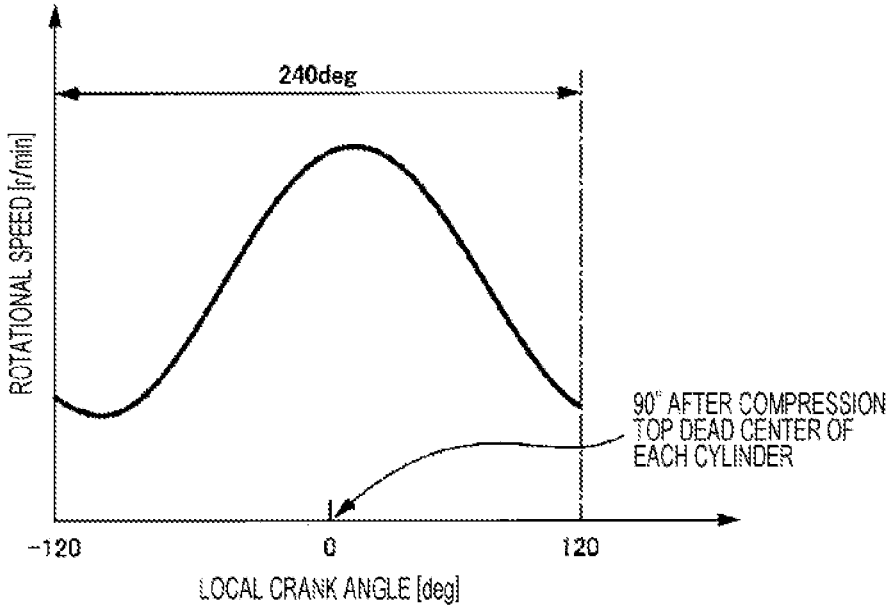
FIG. 10 is an explanatory view illustrating an example in which a crank angle of the rotational speed time-series data in the window is converted into a local crank angle according to the first embodiment of the present invention.

[Conversion into Local Crank Angle] FIG. 10 illustrates an example in which the crank angle of the rotational speed time-series data in each window in FIG. 9 is converted into the local crank angle. The horizontal axis represents the local crank angle [deg], and the vertical axis represents the rotational speed. [rpm].

In this example, the rotational speed time-series data is redefined using the local crank angle in a range of −120° to +120° (with a window width of 240°) in which 90° after the compression top dead center of each cylinder is set to zero. In this manner, the rotational speed time-series data obtained by the conversion into the local crank angles for all the cylinder windows is created in step S5*a* of FIG. 7, and this rotational speed time-series data is delivered to step S5*b*. In step S5*b*, the timing at which the rotational speed becomes maximum is calculated from the rotational speed time-series data converted into the local crank angle.

As described above, the internal combustion engine control device (controller 12) of the resent embodiment includes a rotational speed phase calculation unit (the rotational speed phase calculation unit 122*b*) that divides a period (between crank angles 0° and 720°) of one cycle of a time-series value (the rotational speed time-series data) of a crank rotational speed by the number of cylinders to include a predetermined crank angle) (90°) after a compression top dead center of each cylinder, assigns a time-series value of the crank rotational speed in a divided period as a time-series value (the cylinder window) of the crank rotational speed in the cylinder, and converts the time series (the crank angle) of the time-series value of the crank rotational speed assigned to each cylinder into a time series (local crank angles from −120° to +120°) with a predetermined crank angle after the compression top dead center of each cylinder as a reference (0°). After the time series (local crank angle) is converted for each cylinder, the rotational speed phase calculation unit calculates a phase (local crank angle such as a maximum point) of the crank rotational speed per cylinder from the time-series value of the crank rotational speed assigned to each cylinder.

Figure 11:
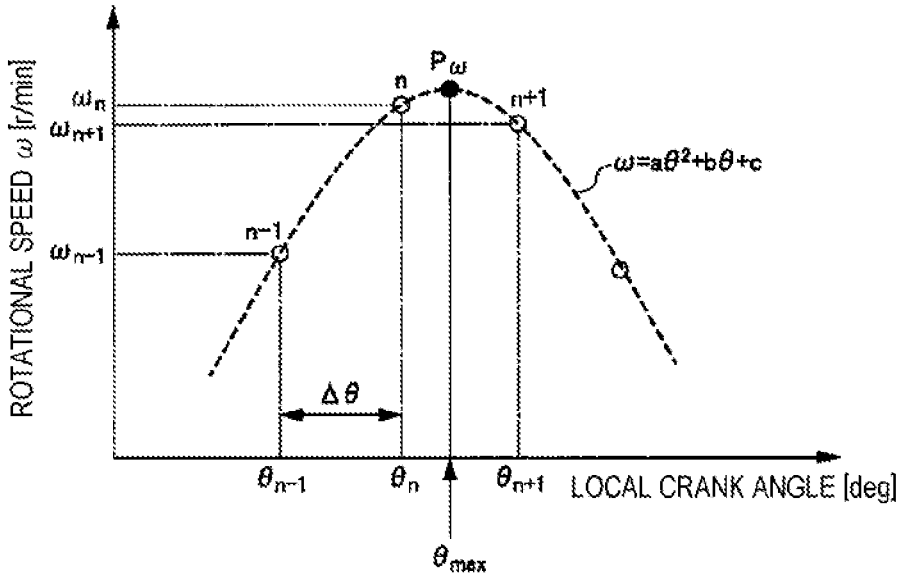
FIG. 11 is an explanatory view illustrating an example of a method of calculating a maximum speed timing of the rotational speed according to the first embodiment of the present invention.

[Method of Calculating Maximum Speed Timing of Rotational speed] FIG. 11 illustrates an example of a method of calculating the maximum speed timing of the rotational speed in step S5*b*. The horizontal axis represents the crank angle [deg], and the vertical axis represents the rotational speed [rpm].

Since the rotational speed time-series data is discrete point data, there is a difference between a maximum speed timing (data point n) of the rotational speed in the discrete point data and a maximum speed timing of an actual rotational speed indicated by a broken line as illustrated in FIG. 11. Therefore, in step S5*b* of FIG. 7, a time-series change of the rotational speed is approximated by a polynomial from the discrete point data, and the maximum speed timing of the rotational speed is obtained from this approximate expression.

Therefore, in step S5*b*, first, the data point n at which the rotational speed becomes the maximum is retrieved from the rotational speed time-series data that is the discrete point data. Then, a local crank angle $\theta_n$ and a rotational speed $\omega_n$ at the data point n, a local crank angle and a rotational speed $\omega_{n-1}$ at a data point (n−1) one discrete point before the data point n, and a local crank angle $\theta_{n+1}$ and a rotational speed $\omega_{n+1}$ at a data point (n+1) one discrete point after the data point n are extracted.

Furthermore, a time-series change in the rotational speed ω is approximated by Formula (2) that is a quadratic function of the local crank angle θ. Here, a, b, and c are constants. In step S5*b*, constants a, b, and c are obtained by solving three systems of linear equations obtained by substituting $\theta_n$, $\omega_n$, $\theta_{n-1}$, $\omega_{n-1}$, $\theta_{n+1}$, and $\omega_{n+1}$ into Formula (2).

[Formula 2]

$$\omega=a\theta^2+b\theta+c \tag{2}$$

A differential value of Formula (2) becomes zero at a point where the rotational speed ω becomes an extreme value. Therefore, in step S5*b*, a local crank angle at which the rotational speed ω becomes the maximum is obtained as a maximum speed timing $\theta_{max}$ from Formula (3) which is a differential expression of Formula (2). The maximum speed timing $\theta_{max}$ thus obtained is used as the phase value θ. $P_\omega$ illustrated in FIG. 11 is a maximum speed point obtained by approximation (interpolation) using a quadratic function.

[Formula 3]

$$\frac{d\omega}{d\theta} = 2a\theta_{max} + b = 0 \tag{3}$$

$$\theta_{max} = -\frac{b}{2a}$$

Note that the rotational speed ω is approximated by the quadratic function of the local crank angle θ in the present embodiment, but the present invention is not limited thereto. For example, the rotational speed ω can be approximated using various continuous functions such as a cubic function and a trigonometric function of the local crank angle θ.

As described above, the internal combustion engine control device (controller 12) of the present embodiment includes a rotational speed phase calculation unit (the rotational speed phase calculation unit 122*b*) that approximates a discrete time-series value (time-series data) of the crank rotational speed by a continuous function (for example, the quadratic function) and calculates a phase of the crank rotational speed using the continuous function.

Returning to FIG. 4, the description of the flowchart of the engine control will be continued.

After step S5, the rotational speed phase calculation unit 122*b* writes the phase value θ into a memory area Mθ(j, k) on the RAM (S6). As the processing of steps S4 and S5 is performed for each cylinder (k=1 to Ncyl), the phase value θ of the rotational speed of each cylinder is obtained.

Then, the rotational speed calculation unit 122*a* and the rotational speed phase calculation unit 122*b* repeat steps S1 to S6 by the number of sampling cycles N (j=1 to N) required for statistical processing, so that the phase value θ of the rotational speed per cylinder in each cycle is stored in the memory area Mθ(j, k). The number of sampling cycles N is, for example, 100.

Next, in steps S7 to S11, the rotational speed phase calculation unit 122*b* obtains a standard deviation $\sigma_\theta$ of the phase values θ in the number of sampling cycles N per cylinder, and writes the standard deviation $\sigma_\theta$ in a memory area $M\sigma_\theta(k)$ on the RAM.

First, the cycle variation calculation unit 122*c* initializes a sum S of the phase values θ and a sum of squares P of the phase values θ to zero before performing loop processing for the number of cycles for a certain cylinder k (S7). Next, when the number of cycles is incremented, the cycle variation calculation unit 122*c* adds a phase value θ(j, k) in a current cycle j to the sum S of the phase values θ in the number of cycles up to the previous cycle (S8).

Further, when the number of cycles is incremented, the cycle variation calculation unit 122*c* adds a square value of the phase value θ(i, k) in the current cycle j to the sum of squares P of the phase values θ in the number of cycles up to the previous cycle (S9). The processing of steps S8 and S9 is repeated for the number of cycles (j=1 to N) to calculate the sum S of the phase values θ in the number of cycles N and the sum of squares P of the phase values θ.

Next, the cycle variation calculation unit 122*c* calculates a mean value θmean of the phase values θ in the number of cycles N for the certain cylinder k. The mean value of the phase values θ is obtained by dividing the sum S of the phase values θ by the number of cycles N (S/N) (S10).

Next, the cycle variation calculation unit 122*c* calculates the standard deviation $\sigma_\theta$ of the phase values θ in the number of cycles N for the certain cylinder k (S11). The standard deviation $\sigma_\theta$ of the phase values θ is obtained using Formula (4). The standard deviation $\sigma_\theta$ obtained by Formula (4) is referred to as a relative standard deviation.

[Formula 4]

$$\sigma_\theta(k)=[\{P/N-\theta\text{mean}^2\}^{1/2}/\theta\text{mean}]\times 100 \tag{4}$$

Next, the cycle variation calculation unit 122*c* calculates a cycle variation rate of the engine torque from the standard deviation $\sigma_\theta(k)$ of the phase value θ (S12).

[Method of Calculating Cycle Variation Rate of Engine Torque] Here, a method of calculating the cycle variation rate (torque variation rate) of the engine torque in step S12 will be described.

Figure 12:
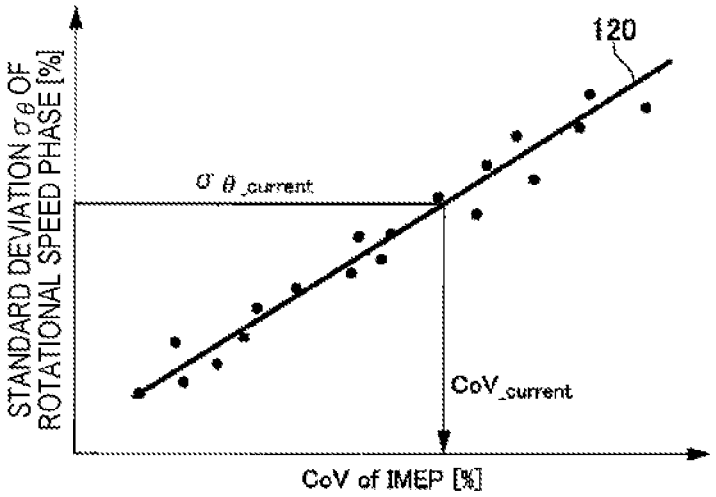
FIG. 12 is an explanatory view illustrating a method of calculating a torque variation rate from a standard deviation of a phase value of the rotational speed according to the first embodiment of the present invention.

FIG. 12 illustrates a correlation between the standard deviation $\theta_\theta$ [%] of the phase value θ and a standard deviation in indicated mean effective pressure IMEP (CoV of IMEP) [%]. A plurality of black circles indicate pieces of sampling data. CoV is an abbreviation for a coefficient of variation.

As indicated by a correlation curve 120, there is a substantially linear correlation between CoV of IMEP (hereinafter, referred to as a "torque variation rate CoV of IMEP"), which indicates the magnitude (degree) of variation of the engine torque per cycle, and the standard deviation $\sigma_\theta$ of the phase value θ. This is because the phase value θ reflects a combustion torque generation timing, and the variation (standard deviation $\sigma_\theta$) in the phase value θ also reflects the variation in the combustion torque generation timing per cycle as described above.

In step S12 of FIG. 4, the cycle variation rate of the engine torque is obtained from the standard deviation $\sigma_\theta(k)$ of the phase value θ by utilizing the presence of the strong correlation between the standard deviation $\sigma_\theta$ of the phase value θ and the torque variation rate CoV of IMEP. Thus, the correlation curve 120 representing the correlation between the standard deviation $\sigma_\theta$ of the phase value θ and the torque variation rate CoV of IMEP is obtained by performing calibration or the like in advance, and is stored in the ROM (storage unit 123) of the controller 12 in the form of a mathematical formula or a reference table. Then, a current torque variation rate CoV_current is obtained from a current standard deviation $\sigma_\theta$_current of the phase value using the correlation curve between the standard deviation $\sigma_\theta$ of the phase difference θ and the torque variation rate CoV of IMEP. The current torque variation rate CoV_current is obtained for each cylinder in a similar procedure, and is delivered to the engine control unit 122*d* in step S13.

[Engine Control] Next, the engine control in step S13 will be described.

For example, in the EGR system, it is necessary to appropriately control an EGR rate in order to enhance the thermal efficiency of the engine 1. In general, when the EGR rate is increased at a partial load, a pumping loss decreases, and the thermal efficiency is enhanced. Further, a combustion temperature is lowered by increasing the EGR rate, and thus, it is also possible to reduce a cooling loss and NOx emission. Furthermore, it is also possible to suppress knocking and reduce an exhaust loss by increasing the EGR rate at a high load. On the other hand, when the EGR rate is excessively high, the ignitability of an air-fuel mixture is lowered or a flame propagation property is lowered, so that the possibility of occurrence of misfire increases. Therefore, it is important to increase the EGR rate as much as possible within a range in which the misfire does not occur or within a range an which the misfire is tolerable in order to increase the thermal efficiency of the engine 1.

When there is a cycle in which the misfire occurs in operating of the engine 1, the cycle variation of the torque increases. Therefore, it is possible to enhance the thermal efficiency of the engine while suppressing the misfire by detecting or estimating the cycle variation rate of the torque and changing the EGR rate based on the magnitude of the cycle variation rate of the torque.

Figure 13:
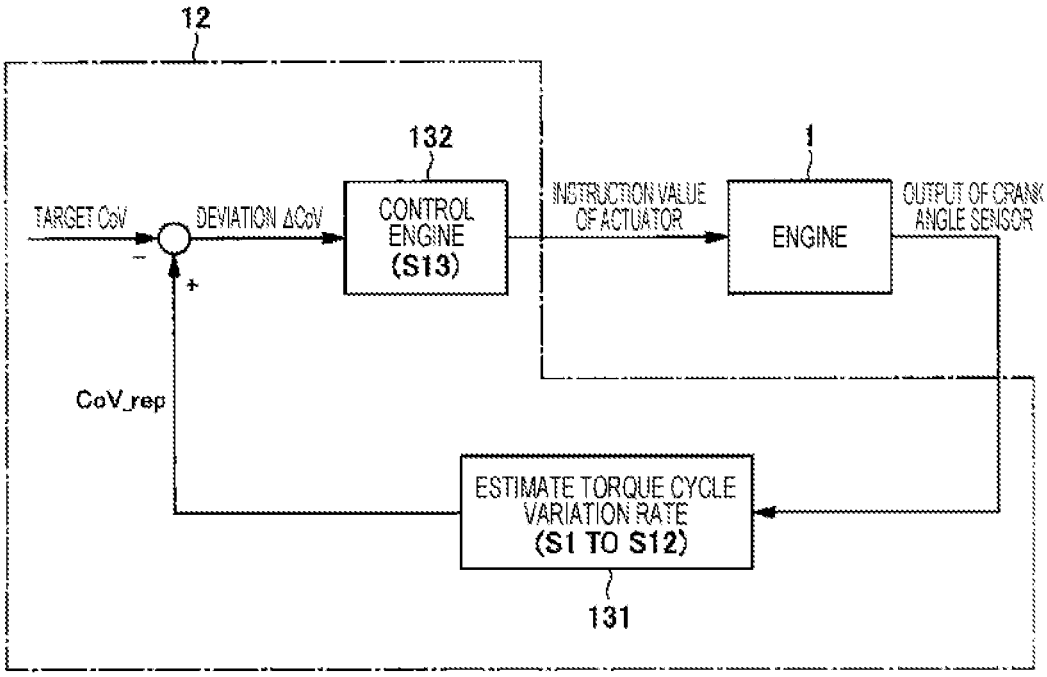
FIG. 13 is an explanatory view illustrating examples of control blocks of the controller that performs EGR control according to the first embodiment of the present invention.

FIG. 13 illustrates examples of control blocks of the controller 12 that performs such EGR control.

In a control block 131, the current cycle variation rate CoV_current of the torque is estimated based on the output of the crank angle sensor 11 of the engine 1 (which corresponds to steps S1 to S12). Since the cycle variation rate CoV_current is obtained for each cylinder, the control block 131 obtains a representative torque variation rate CoV_rep of a current cycle based on the cycle variation rate CoV_current of each cylinder. The control block 131 corresponds to the rotational speed calculation unit 122*a*, the rotational speed phase calculation unit 122*b*, and the cycle variation calculation unit 122*c* illustrated in FIG. 3.

As a way of obtaining the representative torque variation rate CoV_rep, several methods are conceivable. For example, a method of setting a mean value of the torque variation rates CoV of IMEP of the respective cylinders as the representative torque variation rate CoV_rep is conceivable. Further, for example, a method of setting a maximum value of the torque variation rates of the respective cylinders as the representative torque variation rate CoV_rep is conceivable. Further, a method of setting a cycle variation rate CoV_current of a specific cylinder as the representative torque variation rate CoV_rep is also conceivable.

In a control block 132, an instruction value of an actuator of the engine 1 is calculated based on a deviation ΔCoV, obtained by subtracting a target torque variation rate (target CoV) from the representative torque variation rate CoV_rep, to control the engine 1. The control block 132 corresponds to the engine control unit 122*d* illustrated in FIG. 3.

Figure 14:
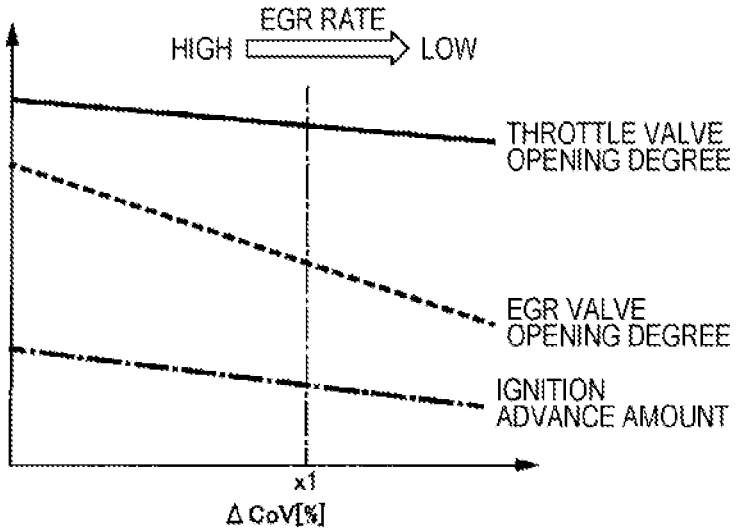
FIG. 14 is an explanatory view illustrating an example of controlling an EGR valve opening degree, a throttle valve opening degree, and an ignition advance amount with respect to a CoV deviation in an EGR system according to the first embodiment of the present invention.

(Control of Actuator in EGR System) FIG. 14 illustrates an example of control of the actuator based on the deviation ΔCoV in the EGR system. The horizontal axis represents the deviation ΔCoV [%], and the vertical axis represents a state of the actuator or the like.

In the control of the actuator based on the deviation ΔCoV in the EGR system, the opening degree (broken line) of the EGR valve 29 and the opening degree (solid line) of the throttle valve 20 are controlled to decrease, for example, in order to suppress the cycle variation of the torque as the deviation ΔCoV increases. Since the EGR rate is lowered by such control, the ignition delay time is shortened, and the combustion speed is increased. Therefore, an ignition retard amount (alternate long and short dash line) is controlled to decrease in order to set the combustion to an appropriate timing (best fuel efficiency timing).

With such control, when the cycle variation of the torque (deviation ΔCoV) is equal to or greater than a predetermined value x1, the EGR rate is set to be low to suppress the cycle variation of the torque. As a result, the control is performed in a direction in which the combustion of the engine 1 becomes stable. Further, when the cycle variation of the torque is smaller than the predetermined value x1, the EGR rate is set to be high, and the thermal efficiency of the engine 1 can be enhanced.

Figure 15:
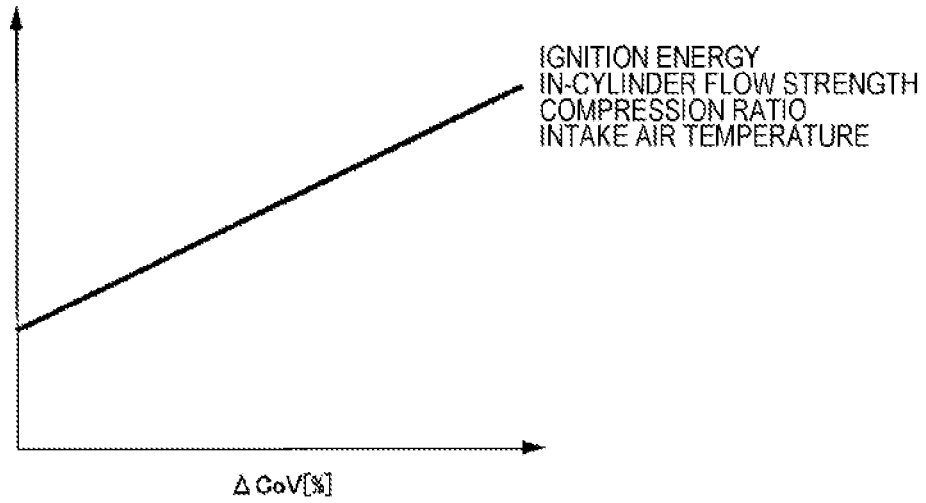
FIG. 15 is an explanatory view illustrating a control example of ignition energy, in-cylinder flow strength, a compression ratio, and an intake air temperature with respect to a CoV deviation in the EGR system according to the first embodiment of the present invention.

Further, it is also conceivable to adopt a configuration in which the amount of ignition energy supplied to the ignition plug 17, the strength of the gas flow in the cylinder, the compression ratio, and the intake air temperature are adjustable, and control these based on the deviation ΔCoV. In general, as the amount of ignition energy, the strength of the gas flow in the cylinder, the compression ratio, and the intake air temperature have higher values, ignition or flame propagation is promoted, and there is an effect of suppressing the torque variation. Therefore, it is desirable to perform control in a direction in which values of these items increase as the deviation ΔCoV increases as illustrated in FIG. 15.

For example, the amount of ignition energy can be adjusted by controlling the amount of current to be supplied to the ignition plug 17, and the strength of the gas flow in the cylinder can be adjusted by controlling a flow velocity of air in the intake port 21. Further, for example, the compression ratio can be adjusted by controlling a position of a top dead center of the piston 14, and the intake air temperature can be adjusted by controlling on and off of a heater provided in the intake port 21.

Note that, in the control of these, any of the strength of the gas flow, the compression ratio, and the intake air temperature may be controlled alone, or some thereof may be controlled in combination. Further, the control may be combined with the above-described control of the EGR valve opening degree, the throttle valve opening degree, or the ignition advance amount.

Furthermore, in a lean combustion system, it is also necessary to appropriately control an air-fuel ratio in order to enhance the thermal efficiency of the engine 1. In general, when the air-fuel ratio is increased at a partial load, the pumping loss decreases, and the thermal efficiency is enhanced. Further, the combustion temperature is lowered by increasing the air-fuel ratio, and thus, it is also possible to reduce the cooling loss and the NOx emission. On the other hand, when the air-fuel ratio is excessively high, the ignitability of the air-fuel mixture is lowered or the flame propagation property is lowered, so that the possibility of occurrence of misfire increases. Therefore, it is important to increase the air-fuel ratio as much as possible within a range in which the misfire does not occur or within a range in which the misfire is tolerable in order to increase the thermal efficiency of the engine 1.

Figure 16:
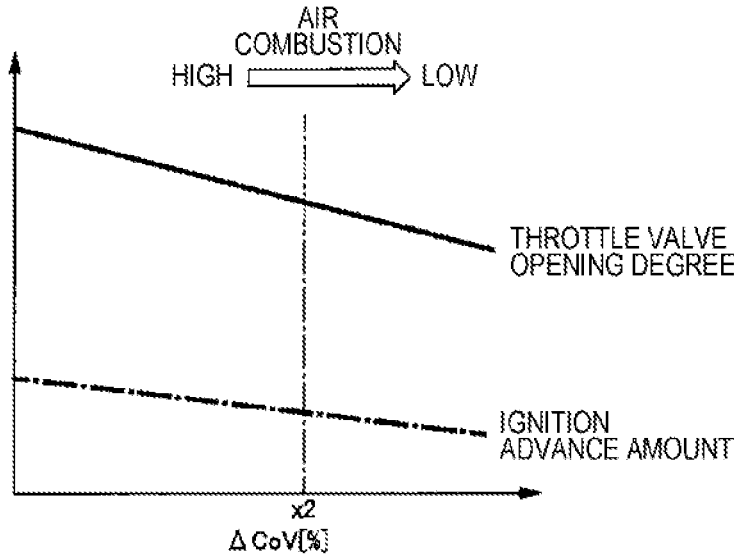
FIG. 16 is an explanatory view illustrating an example of control of a throttle valve opening degree and an ignition advance amount with respect to a CoV deviation in a lean combustion system according to the first embodiment of the present invention.

(Control of Actuator in Lean Combustion System) FIG. 16 illustrates an example of control of an actuator based on the deviation ΔCoV in the lean combustion system. The horizontal axis represents the deviation ΔCoV [%], and the vertical axis represents a state of the actuator or the like.

In the control of the actuator based on the deviation ΔCoV in the lean combustion system, for example, the opening degree (solid line) of the throttle valve 20 is controlled to decrease in order to suppress the cycle variation of the torque as the deviation ΔCoV increases. Since the air-fuel ratio is lowered by such control, the ignition delay time is shortened, and the combustion speed is increased. Therefore, an ignition retard amount (alternate long and short dash line) is controlled to decrease in order to set the combustion to an appropriate timing (best fuel efficiency timing).

With such control, when the cycle variation of the torque (deviation ΔCoV) is equal to or greater than a predetermined value x2, the air-fuel ratio is set to be low to suppress the cycle variation of the torque. As a result, the control is performed in a direction in which the combustion of the engine 1 becomes stable. Further, when the cycle variation of the torque is smaller than the predetermined value x2, the air-fuel ratio is set to be high, and the thermal efficiency can be enhanced.

Further, the control of the amount of ignition energy, the strength of the gas flow in the cylinder, the compression ratio, and the intake air temperature illustrated in FIG. 15 can also be applied to the lean combustion system in a similar manner as in the EGR system described above.

Figure 17:
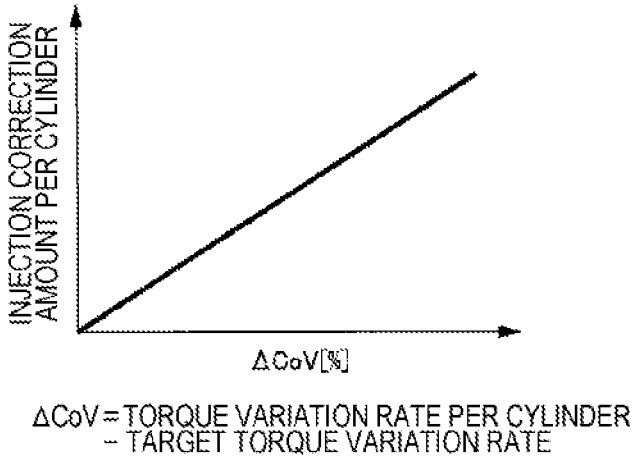
FIG. 17 is an explanatory view illustrating an example of a fuel injection correction amount with respect to a CoV deviation per cylinder in the lean combustion system according to the first embodiment of the present invention.

[Engine Control for Each Cylinder] Note that it is also conceivable to perform different engine control for each cylinder based on the current torque variation rate CoV_current per cylinder. FIG. 17 illustrates an example in which the deviation ΔCoV of the torque variation rate per cylinder and correction control of the fuel injection amount based on the deviation ΔCoV are applied to the lean combustion system. In this example, a difference between the torque variation rate and the target torque variation rate per cylinder is set to ΔCoV [%], and the fuel injection amount per cylinder is corrected in proportion to ΔCoV.

Figure 18:
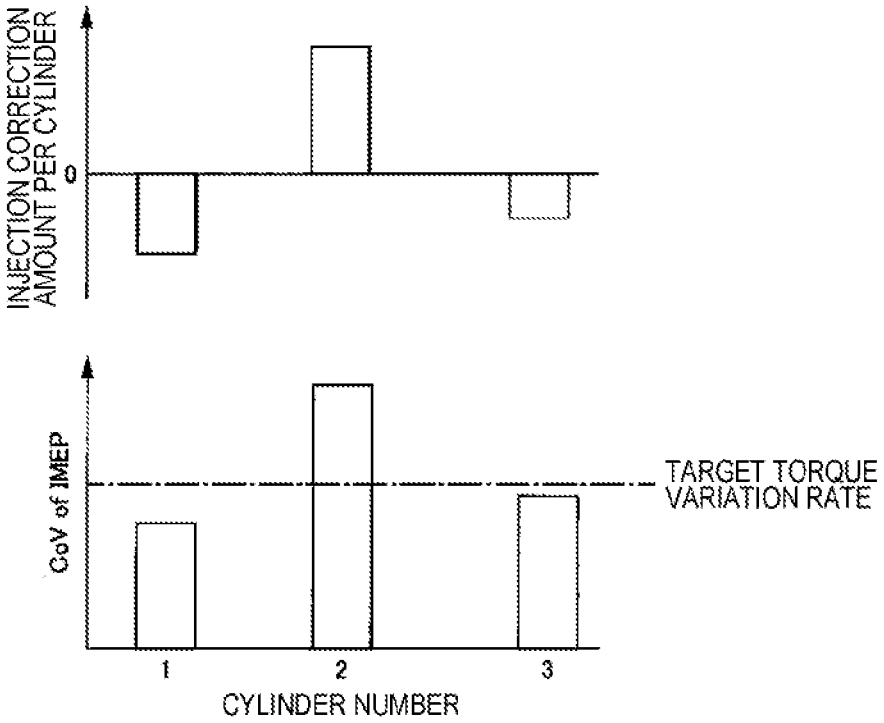
FIG. 18 is an explanatory view illustrating an example of correction control of a fuel injection amount based on a torque variation rate per cylinder according to the first embodiment of the present invention.

FIG. 18 illustrates the torque variation rate (CoV of IMEP) per cylinder and correction control of the fuel injection amount based on the torque variation rate.

In a case where different engine control is performed for each cylinder, correction is performed in a direction in which an air-fuel ratio decreases by increasing a fuel injection amount in a cylinder in which a torque variation rate is larger than a target value (target torque variation rate). On the other hand, in a cylinder in which a torque variation rate is smaller than the target value, correction is performed in a direction in which an air-fuel ratio increases by decreasing a fuel injection amount. As a result, the torque variation rate of each cylinder approaches the target value, and it is possible to achieve both high fuel efficiency and reduction in cycle variation.

In an example on the lower side of FIG. 18, torque variation rates of the first cylinder and the third cylinder are smaller than a target value torque variation rate, and a torque variation rate of the second cylinder is larger than the target value torque variation rate. Thus, as illustrated in the upper side of FIG. 18, correction amounts are set in a direction in which fuel injection amounts of the first cylinder and the third cylinder decreases, and a correction amount is set in a direction in which a fuel injection amount of the second cylinder increases.

As described above, the internal combustion engine control device (controller 12) according to the first embodiment includes a rotational speed calculation unit (the rotational speed calculation unit 122*a*), a rotational speed phase calculation unit (the rotational speed phase calculation unit 122*b*), and a first cycle variation calculation unit (the cycle variation calculation unit 122*c*). The rotational speed calculation unit calculates a time-series value (time-series data) of a crank rotational speed (the rotational speed ω) of the internal combustion engine (engine 1). The rotational speed phase calculation unit calculates a phase (the phase value θ) of the crank rotational speed from the time-series value of the crank rotational speed calculated by the rotational speed calculation unit. The first cycle variation calculation unit calculates the magnitude (standard deviation $\sigma_\theta$) of a cycle-to-cycle variation of the phase of the crank rotational speed calculated by the rotational speed phase calculation unit.

The internal combustion engine control device configured as described above can accurately estimate the stable combustion state, and does not use a pressure sensor, and thus, requires low cost. Further, the engine can be simplified as compared with the related art since the pressure sensor is not installed.

Further, as described above, the internal combustion engine control device (controller 12) of the present embodiment includes an engine control unit (engine control unit 122*d*) that controls the internal combustion engine based on the calculated magnitude (standard deviation $\sigma_\theta$) of the cycle-to-cycle variation of the phase (phase value θ) of the crank rotational speed.

Further, as described above, in the internal combustion engine control device (controller 12) of the present embodiment, the first cycle variation calculation unit obtains a torque variation rate (the representative torque variation rate CoV_rep) of the cylinder based on the magnitude (standard deviation $\sigma_\theta$) of the cycle-to-cycle variation of the phase of the crank rotational speed. Further, the engine control unit controls at least one of an opening degree of an exhaust gas recirculation valve (the EGR valve 29), an opening degree of a throttle valve (the throttle valve 20), an ignition timing, ignition energy, in-cylinder flow strength, a compression ratio, an intake air temperature, and a fuel injection amount to make a difference (the deviation ΔCoV) between the torque variation rate and a target torque variation rate (target CoV) smaller than a predetermined value (x1 or x2).

Further, as described above, in the internal combustion. engine control device (controller 12) of the present embodiment, the first cycle variation calculation unit obtains the torque variation rate of each of a plurality of the cylinders (the first cylinder to the third cylinder) based on the magnitude (standard deviation $\sigma_\theta$) of the cycle-to-cycle variation of the phase of the crank rotational speed. Further, the engine control unit corrects the fuel injection amount of each cylinder based on the difference (deviation ΔCoV) between the torque variation rate of each cylinder and the target torque variation rate (target CoV).

[Effects of First Embodiment] Effects of the present embodiment as compared with the related art will be described with reference to FIG. 19.

Figure 19:
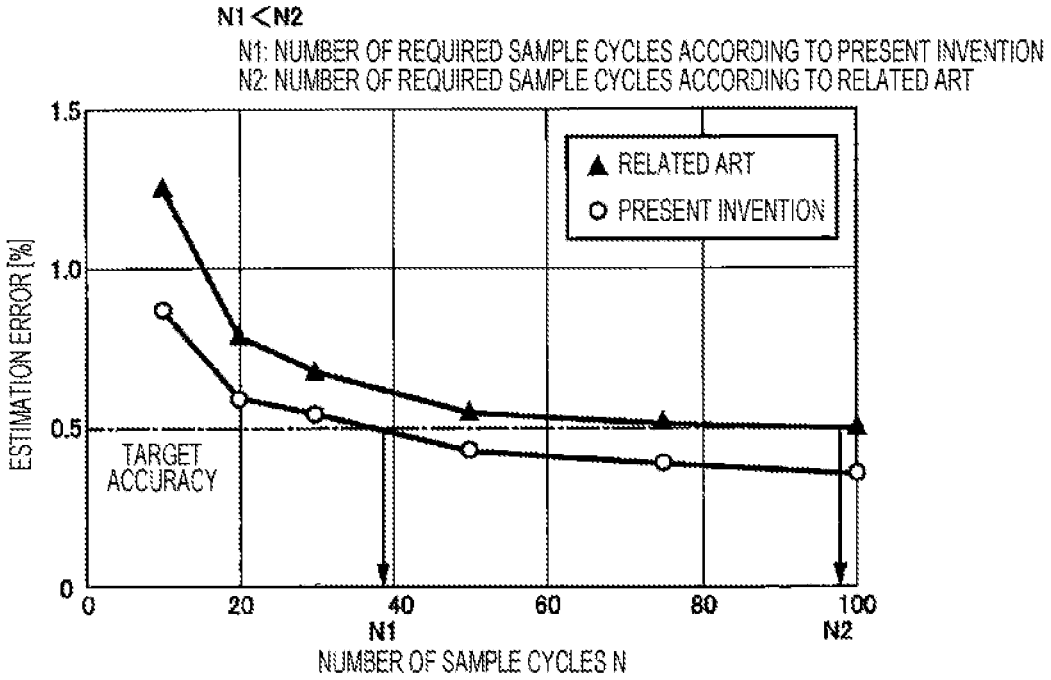
FIG. 19 is an explanatory view illustrating a relationship between an estimation error of a cycle variation rate and the number of sample cycles according to each of the present invention and the related art.

FIG. 19 is actual measurement results illustrating a relationship between an estimation error of a cycle variation rate of a torque and the number of sample cycles N according to each of the present embodiment and the related art. This actual measurement result is a result of measurement at a certain EGR rate when a rotational speed is 2400 rpm. Sampling data according to the related art is indicated by a triangle mark '▲', and sampling data according to the present embodiment is indicated by a circle mark 'o'.

Figure 20:
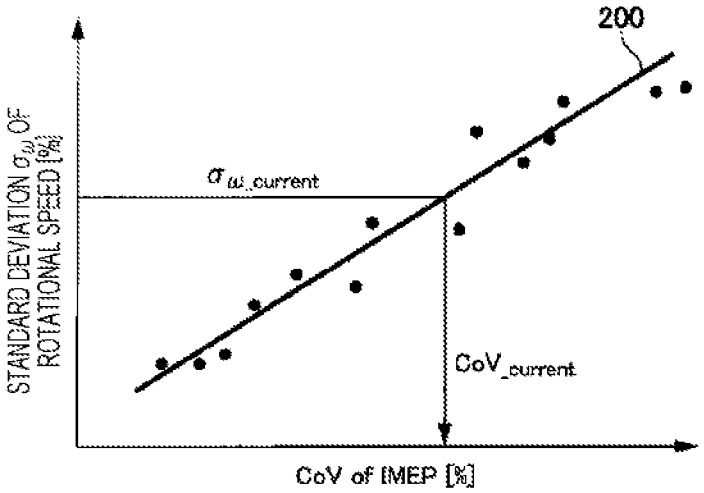
FIG. 20 is an explanatory view illustrating a method of calculating a torque variation rate from a standard deviation of a rotational speed according to the related art.

The cycle variation rate of the torque according to the related art is estimated using a standard deviation $\sigma_\omega$ of a cycle average rotational speed ω detected by the crank angle sensor 11. More specifically, as illustrated in FIG. 20, a correlation curve 200 is created from correlation data of the standard deviation $\sigma_\omega$ of the rotational speed ω and the cycle variation rate (CoV of IMEP) of the torque, and a cycle variation rate CoV_current of the torque is estimated from a current standard deviation $\sigma_\omega$_current of the rotational seed using the correlation curve 200.

As illustrated in FIG. 19, the cycle variation rate of the torque is estimated based on a standard deviation value of the sampling data in both the present embodiment and the related art. Therefore, when the number of cycles for sampling the sampling data decreases, the estimation error of the cycle variation rate of the torque increases. On the other hand, the estimation error of the cycle variation rate of the torque according to the present embodiment is smaller than the estimation error according to the related art when compared by applying the same number of sample cycles. Thus, the present embodiment has an advantage that the same estimation error (corresponding to, for example, target accuracy) can be obtained with a smaller number of cycles (N1) than that (N2) in the related art. In FIG. 19, the target accuracy is an estimation error of 0.5% or less.

According to the actual measurement results of FIG. 19, a detection time (the number of required sample cycles) at the same estimation error can be reduced in the present embodiment by about 60% as compared with that in the related art. Further, the present embodiment can reduce the estimation error for the same detection time (the number of required sample cycles) by about 20% to 30% as compared with that in the related art.

Here, the reason why the present embodiment has higher estimation accuracy than the related art will be described.

A large moment of inertia caused by a piston, a connecting rod, a vehicle drive system, or the like of the engine 1 acts around the crankshaft of the engine 1. Therefore, a cycle variation component of a combustion torque is attenuated by an effect of inertia in the process of being converted into a variation component of a rotational speed. In the related art, the magnitude of a variation component of a rotational speed is used as an index of a cycle variation of a torque, and thus, an S/N is low for the above-described reason, and the estimation error of the cycle variation rate of the torque increases.

On the other hand, in the present embodiment, the magnitude of a variation component of a phase of a rotational speed is used as an index of the cycle variation of the torque. Since the phase of the rotational speed is hardly affected by the moment of inertia around the crankshaft, the attenuation in the process in which the torque variation is converted into the phase variation is small. As a result, the present embodiment has a higher S/N and higher estimation accuracy of the cycle variation rate or the torque as compared with the related art.

A control speed of the EGR, lean combustion, or the like based on cycle variation rate of a torque depends on an estimation time (that is, the required number of sample cycles) of the cycle variation rate of the torque. If the cycle variation rate of the torque can be estimated in a short time (a small number of sample cycles), the EGR, lean combustion, or the like can be controlled at a higher speed. In particular, when the engine 1 is operated in a transient state, a rate at which the engine 1 can be operated in a more optimal state is increased by high-speed control (in other words, control with good response). This is effective in reducing fuel consumption and emission, improving acceleration performance, and the like. Further, for example, when the emission is reduced, various devices for countermeasures against the emission can be simplified, and there is also an effect of reducing system cost.

<Second Embodiment> [Switching with Conventional Method] As described above, the method of estimating the torque variation based on the standard deviation $\sigma_\theta$ of the phase of the rotational speed can accurately estimate the cycle variation rate of the torque in a short time. On the other hand, in order to obtain the phase of the rotational speed, it is necessary to perform Fourier series expansion or polynomial approximation for each cycle, and a computational load of the controller 12 is large as compared with a conventional method of estimating the torque variation based on the standard deviation $\sigma_\omega$ of the rotational speed. Therefore, it is conceivable to perform engine control by switching between the method of estimating the torque variation based on the standard deviation $\sigma_\omega$ of the rotational speed and the method of estimating the torque variation based on the standard deviation $\sigma_\theta$ of the speed phase according to a state of an engine or the like.

Figure 21:
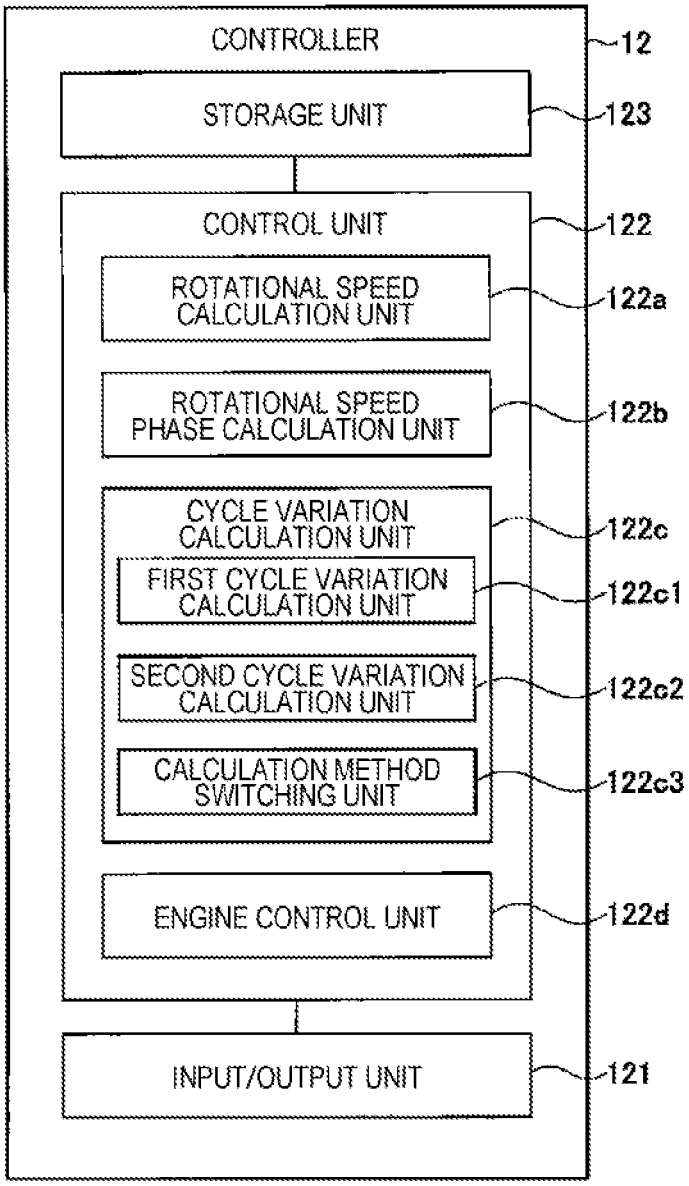
FIG. 21 is a block diagram illustrating a configuration example of a controller according to a second embodiment of the present invention.

FIG. 21 is a block diagram illustrating a configuration example of a controller according to a second embodiment of the present invention.

In the controller 12 according to the present embodiment, the cycle variation calculation unit 122*c* includes a first cycle variation calculation unit 122*c*1, a second cycle variation calculation unit 122*c*2, and a calculation method switching unit 122*c*3.

The first cycle variation calculation unit 122*c*1 has the same function as the cycle variation calculation unit 122*c* illustrated in FIG. 2. That is, the first cycle variation calculation unit 122*c*1 the magnitude (degree) of a cycle-to-cycle variation for a phase value of time-series data of a crank rotational speed obtained by the rotational speed phase calculation unit 122*b*. Further, the cycle variation calculation unit 122*c* calculates the magnitude (degree) of a cycle variation of an engine torque based on the magnitude (degree) of the cycle-to-cycle variation of the phase value of the time-series data of the crank rotational speed, and outputs the result thereof to the engine control unit 122*d*.

The second cycle variation calculation unit 122*c*2 calculates the magnitude (degree) of a cycle-to-cycle variation for the time-series data the crank rotational speed obtained by the rotational speed phase calculation unit 122*b*. Further, the second cycle variation calculation unit 122*c*2 calculates the magnitude (degree) of the cycle variation of the engine torque based on the magnitude (degree) of the cycle-to-cycle variation of the time-series data of the crank rotational speed, and outputs the result thereof to the engine control unit 122*d*. Thus, the correlation curve 200 representing the correlation between the standard deviation $\sigma_\omega$ of the rotational speed and the torque variation rate CoV of IMEP is stored in a ROM (the storage unit 123) in the second embodiment.

The calculation method switching unit 122*c*3 switches use of the first cycle variation calculation unit 122*c*1 and the second cycle variation calculation unit 122*c*2 based on the magnitude of an operating parameter representing an operation state of an internal combustion engine (the engine 1). Note that the calculation method switching unit 122*c*3 may be provided outside the cycle variation calculation unit 122*c*.

The engine control unit 122*d* controls the internal combustion engine (engine 1) based on the magnitude of the cycle variation of the phase of the crank rotational speed calculated by the first cycle variation calculation unit 122*c*1 or the magnitude of the cycle variation of the crank rotational speed calculated by the second cycle variation calculation unit 122*c*2.

(Switching of Calculation Method) Next, a method of switching a calculation method of a torque variation rate in an EGR system will be described with reference to FIG. 22.

Figures 22, 23:
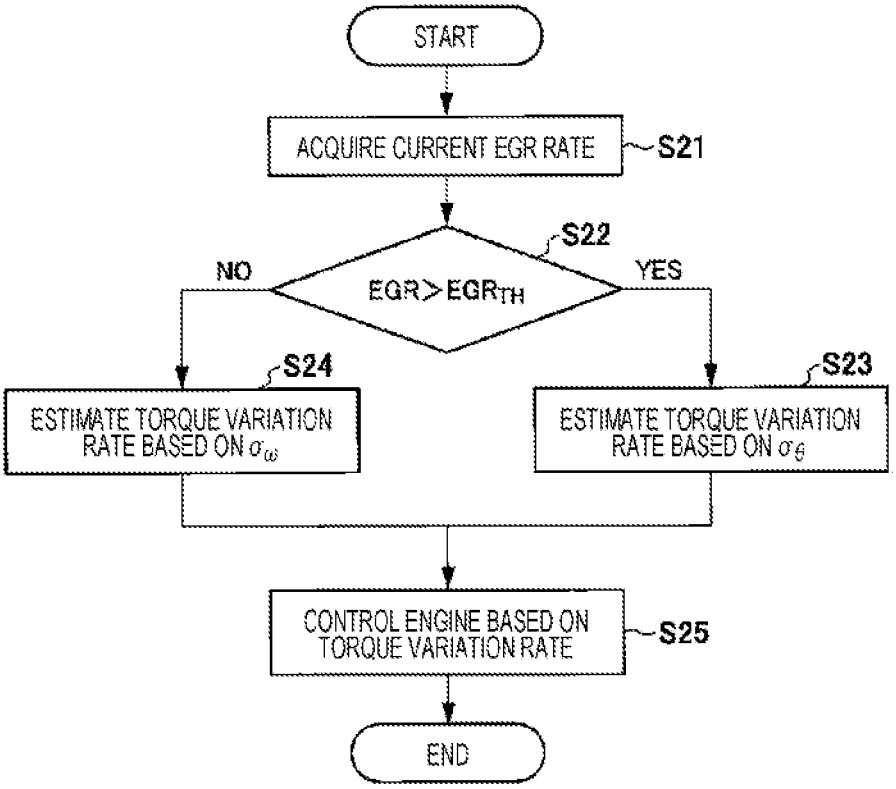
FIG. 22 is a flowchart illustrating a procedure example of a process of switching a calculation method of a torque variation rate using an EGR rate according to the second embodiment of the present invention.
FIG. 23 is an explanatory view illustrating examples of an operating parameter of an engine used for switching of the calculation method of the torque variation rate according to the second embodiment of the present invention.

FIG. 22 is a flowchart illustrating a procedure example of a process of switching the calculation method of the torque variation rate using an EGR rate. In this example, the method of estimating the torque variation rate based on the standard deviation $\sigma_\theta$ of the speed phase and the method of estimating the torque variation rate based on the standard deviation $\sigma_\omega$ of a rotational speed (see FIG. 20) are switched.

First, the calculation method switching unit 122*c*3 acquires a current EGR rate of the engine 1 (S21), and compares the current EGR rate with a threshold $EGR_{th}$ of the EGR rate (S22). Then, when the current EGR rate is higher than $EGR_{th}$ (YES in S22), the calculation method switching unit 122*c*3 estimates the torque variation based on the standard deviation $\sigma_\theta$ of a phase value of the rotational speed (S23). On the other hand, when the current EGR rate is equal to or lower than $EGR_{th}$ (NO in S22), the calculation method switching unit 122*c*3 estimates the torque variation based on the standard deviation $\sigma_\omega$ of the rotational speed (S24).

Then, the engine control unit 122*d* performs engine control based on the torque variation rate estimated in any one of step S23 and S24 (S25). After this step ends, the process in the flowchart ends.

In general, a cycle variation of the torque is large when the EGR rate is high. In order to suppress this, it is required to accurately estimate the torque variation rate and perform the EGR control with a small number of sample cycles. On the other hand, the cycle variation of the torque is generally small when the EGR rate is low, and thus, the estimation accuracy of the torque variation rate is not necessarily so high. Therefore, the estimation accuracy and a computational load can be suitably balanced by switching between the method of estimating the torque variation based on the standard deviation $\sigma_\omega$ of the rotational speed and the method of estimating the torque variation based on the standard deviation $\sigma_\theta$ of the phase value of the rotational speed.

Note that a switching method based on another operating parameter is conceivable other than the EGR rate regarding the switching between the two methods for estimating the torque variation rate.

(Example of Operating Parameter) FIG. 23 illustrates examples of the operating parameter of the engine 1 used for switching of the calculation method of the torque variation rate.

Examples of a situation in which engine control with a small number of cycles is required based on the cycle variation of the torque include a case where an air-fuel ratio of a lean combustion system is large, a case where an engine load (torque) is low, a case where a cooling water temperature is low, and a case such as a transient operation state. Therefore, in these cases, it is desirable to estimate the torque variation rate based on the standard deviation $\sigma_\propto$ of the phase value $\theta$ of the rotational speed.

A transient/steady state of the engine 1 is determined by a change rate of the rotational speed within a predetermined time, a change rate of the engine load (torque) within a predetermined time, or the like.

Further, when the rotational speed is lower than a predetermined value or when a current ECU load factor is lower than a predetermined value, witching to the method of estimating the torque variation rate based on the standard deviation $\sigma_\theta$ of the phase of the rotational speed is performed so that it is possible to prevent an excessive computational load.

As described above, an internal combustion engine control device (the controller 12) according to the second embodiment switches between a first cycle variation calculation unit (the first cycle variation calculation unit 122*c*1) and a second cycle variation calculation unit (the second cycle variation calculation unit 122*c*2), and includes: the second cycle variation calculation unit that calculates the magnitude (standard deviation $\sigma_\omega$) of a cycle-to-cycle variation of a crank rotational speed calculated by a rotational speed calculation unit (the rotational speed calculation unit 122*a*); and an engine control unit (the engine control unit 122*d*) that controls an internal combustion engine based on either the magnitude (standard deviation $\sigma_\theta$) of a cycle-to-cycle variation of a phase of the crank rotational speed calculated by the first cycle variation calculation unit or the magnitude (standard deviation $\sigma_\omega$) of the cycle-to-cycle variation of the crank rotational speed calculated by the second cycle variation calculation unit.

Further, as described above, the internal combustion engine control device (controller 12) of the present embodiment includes a calculation method switching unit (the calculation method switching unit 122*c*3) that switches use of the first cycle variation calculation unit and the second cycle variation calculation unit based on the magnitude of an operating parameter representing an operation state of the internal combustion engine.

Further, as described above, in the present embodiment, the operating parameter is at least any one the exhaust gas recirculation rate (EGR rate), the air-fuel ratio, the engine load, the cooling water temperature, the steady state/transient state, the crank rotational speed, and the load factor of the internal combustion engine control device (the controller 12 or the ECU).

Further, in the present embodiment, the engine control unit (engine control unit 122*d*) determines whether the internal combustion engine is in the steady state or the transient state based on a torque change rate or a crank rotational speed change rate for a predetermined time as described above.

<Others> Furthermore, the present invention is not limited to the above-described respective embodiments, and it is a matter of course that various other applications and modifications can be made without departing from a gist of the invention described in the claims.

For example, the above-described respective embodiments describe the detailed and concrete description of the configuration of the controller 12 in order to describe the present invention in an easily understandable manner, and are not necessarily limited to one including all the constituent elements that have been described above. Further a part of a configuration of a certain embodiment can be replaced with a constituent element of another embodiment. Further, a configuration of one embodiment can be also added with a constituent element of another embodiment. Further, addition, substitution, or deletion of other constituent elements can be also made with respect to some configurations of each embodiment.

Further, a part or all of each of the above-described configurations, functions, processing units, and the like of the controller 12 may be implemented, for example, by hardware by designing with an integrated circuit and the like. As the hardware, a field programmable gate array (FPGA), an application specific integrated circuit (ASIC), or the like may be used.

Further, a plurality processes may be executed in parallel or the processing order may be changed within a range not affecting the processing result in the flowchart illustrated in FIG. 4.

REFERENCE SIGNS LIST

11 crank angle sensor
12 controller

17 ignition plug
20 throttle valve
26 timing rotor
28 EGR pipe
29 EGR valve
121 input/output unit
122 control unit
122*a* rotational speed calculation unit
122*b* rotational speed phase calculation unit
122*c* cycle variation calculation unit
122*c*1 first cycle variation calculation unit
122*c*2 second cycle variation calculation unit
122*c*3 calculation method switching unit
122*d* engine control unit
123 storage unit

The invention claimed is:

1. An internal combustion engine control device comprising:

a rotational speed calculation unit that calculates a time-series value of a crank rotational speed of an internal combustion engine;

a rotational speed phase calculation unit that calculates a phase of the crank rotational speed from the time-series value of the crank rotational speed calculated by the rotational speed calculation unit; and a first cycle variation calculation unit that calculates a magnitude of a cycle-to-cycle variation of the phase of the crank rotational speed calculated by the rotational speed phase calculation unit.

2. The internal combustion engine control device according to claim 1, wherein the rotational speed phase calculation unit calculates, as the phase of the crank rotational speed, a crank angle at which the crank rotational speed is maximized or minimized.

3. The internal combustion engine control device according to claim 1, wherein the rotational speed phase calculation unit calculates, as the phase of the crank rotational speed, a crank angle when the crank rotational speed changes across a predetermined rotational speed.

4. The internal combustion engine control device according to claim 1, wherein the rotational speed calculation unit performs finite-order Fourier series expansion on a time-series value of the crank rotational speed obtained from a detection result of a rotation angle sensor that detects a rotation angle of the crank to reconstruct the time-series value of the crank rotational speed.

5. The internal combustion engine control device according to claim 1, wherein the rotational speed phase calculation unit divides a period of one cycle of the time-series value of the crank rotational speed by a number of cylinders to include a predetermined crank angle after a compression top dead center of each of the cylinders, assigns a time-series value of the crank rotational speed in a divided period as a time-series value of the crank rotational speed in the cylinder, converts a time series of the time-series value of the crank rotational speed assigned to each of the cylinders into a time series with a predetermined crank angle after the compression top dead center of each of the cylinders as a reference, and calculates the phase of the crank rotational speed for each of the cylinders from the time-series value of the crank rotational speed assigned to each of the cylinders after the time series is converted for each of the cylinders.

6. The internal combustion engine control device according to claim 2, wherein the rotational speed phase calculation unit approximates a discrete time-series value of the crank rotational speed by a continuous function, and calculates the phase of the crank rotational speed using the continuous function.

7. The internal combustion engine control device according to claim 1, further comprising an engine control unit that controls the internal combustion engine based on the calculated magnitude of the cycle-to-cycle variation of the phase of the crank rotational speed.

8. The internal combustion engine control device according to claim 7, wherein the first cycle variation calculation unit obtains a torque variation rate of a cylinder based on the magnitude of the cycle-to-cycle variation of the phase of the crank rotational speed, and the engine control unit controls at least one of an opening degree of an exhaust gas recirculation valve, an opening degree of a throttle valve, an ignition timing, ignition energy, in-cylinder flow strength, a compression ratio, an intake air temperature, and a fuel injection amount to make a difference between the torque variation rate and a target torque variation rate smaller than a predetermined value.

9. The internal combustion engine control device according to claim 7, wherein the first cycle variation calculation unit obtains a torque variation rate of each of a plurality of cylinders based on the magnitude of the cycle-to-cycle variation of the phase of the crank rotational speed, and the engine control unit corrects a fuel injection amount of each of the cylinders based on a difference between the torque variation rate of each of the cylinders and a target torque variation rate.

10. The internal combustion engine control device according to claim 1, further comprising:

a second cycle variation calculation unit that calculates a magnitude of a cycle-to-cycle variation of the crank rotational speed calculated by the rotational speed calculation unit; and an engine control unit that switches between the first cycle variation calculation unit and the second cycle variation calculation unit, and controls the internal combustion engine based on any one of the magnitude of the cycle-to-cycle variation of the phase of the crank rotational speed calculated by the first cycle variation calculation unit and the magnitude of the cycle-to-cycle variation of the crank rotational speed calculated by the second cycle variation calculation unit.

11. The internal combustion engine control device according to claim 10, further comprising a calculation method switching unit that switches use of the first cycle variation calculation unit and the second cycle variation calculation unit based on a magnitude of an operating parameter representing an operation state of the internal combustion engine.

12. The internal combustion engine control device according to claim 11, wherein the operating parameter is at least any of an exhaust gas recirculation rate, an air-fuel ratio, an engine load, a cooling water temperature, the crank rotational speed, a load factor of the internal combustion engine control device, and a steady state/transient state.

13. The internal combustion engine control device according to claim 12, wherein the engine control unit determines whether the internal combustion engine is in a steady state or a transient state based on a torque change rate or a crank rotational speed change rate for a predetermined time.

14. An internal combustion engine control method of controlling an internal combustion engine according to a state of the internal combustion engine, the internal combustion engine control method comprising:

a process of calculating a time-series value of a crank rotation speed of the internal combustion engine;

a process of calculating a phase of the crank rotational speed from the time-series value of the crank rotational speed; and a process of calculating a magnitude of a cycle-to-cycle variation of the phase of the crank rotational speed.

* * * * *